US011156935B2

(12) United States Patent
Koyanagi et al.

(10) Patent No.: US 11,156,935 B2
(45) Date of Patent: Oct. 26, 2021

(54) DEVELOPING MEMBER, ELECTROPHOTOGRAPHIC PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Takashi Koyanagi, Mishima (JP); Kentarou Nakamura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/988,986

(22) Filed: Aug. 10, 2020

(65) Prior Publication Data

US 2021/0063910 A1 Mar. 4, 2021

(30) Foreign Application Priority Data

Aug. 26, 2019 (JP) ..... JP2019-154096

(51) Int. Cl.
*G03G 15/08* (2006.01)
*G03G 15/02* (2006.01)

(52) U.S. Cl.
CPC ..... *G03G 15/0818* (2013.01); *G03G 15/0233* (2013.01); *G03G 2215/0607* (2013.01)

(58) Field of Classification Search
None
See application file for complete search history.

(56) References Cited

U.S. PATENT DOCUMENTS

| | | | |
|---|---|---|---|
| 5,112,656 | A | 5/1992 | Nakamura et al. |
| 5,229,237 | A | 7/1993 | Kawamorita et al. |
| 5,357,320 | A | 10/1994 | Kashimura et al. |
| 5,393,628 | A | 2/1995 | Ikezue et al. |
| 5,455,135 | A | 10/1995 | Maruyama et al. |
| 5,485,250 | A | 1/1996 | Kashimura et al. |
| 5,667,926 | A | 9/1997 | Maruyama et al. |
| 5,693,443 | A | 12/1997 | Nakamura et al. |

(Continued)

FOREIGN PATENT DOCUMENTS

| | | |
|---|---|---|
| EP | 3531211 A1 | 8/2019 |
| JP | H03-177865 | 8/1991 |

(Continued)

*Primary Examiner* — Sevan A Aydin
(74) *Attorney, Agent, or Firm* — Venable LLP

(57) ABSTRACT

The developing member includes a substrate having an electroconductive outer surface; an insulating resin layer on the outer surface of the substrate; and electrically insulating domains on an outer surface of insulating resin layer, and has an outer surface including a surface of the insulating resin layer and surfaces of the domains, wherein a potential decay time constant of each of the surfaces of the domains is ≥60.0 seconds, and a potential decay time constant of the surface of the electrically insulating resin layer is <6.0 seconds, and assuming that the electrically insulating domains are orthographically projected onto the outer surface of the substrate, to obtain projection images of the respective domains, each of areas of the projection images is defined as S, and each of areas of convex envelopes of the projection images is defined as H, at least one of the domains satisfies 0.05≤S/H≤0.80.

14 Claims, 14 Drawing Sheets

(56) References Cited

U.S. PATENT DOCUMENTS

| | | | | |
|---|---|---|---|---|
| 5,729,801 | A | 3/1998 | Maruyama et al. | |
| 5,837,412 | A | 11/1998 | Suzuki et al. | |
| 5,923,925 | A | 7/1999 | Nakamura et al. | |
| 5,932,383 | A | 8/1999 | Nakata et al. | |
| 6,016,414 | A | 1/2000 | Anayama et al. | |
| 6,664,014 | B1 | 12/2003 | Kikuchi et al. | |
| 6,942,952 | B2 | 9/2005 | Uesugi et al. | |
| 8,655,222 | B2 | 2/2014 | Nakamura et al. | |
| 8,768,226 | B2 | 7/2014 | Koyanagi et al. | |
| 8,791,971 | B2 * | 7/2014 | Marcus | B41J 2/18 347/112 |
| 8,798,508 | B2 | 8/2014 | Yamada et al. | |
| 9,625,854 | B2 | 4/2017 | Koyanagi et al. | |
| 9,977,359 | B2 | 5/2018 | Koyanagi et al. | |
| 10,197,930 | B2 | 2/2019 | Yamada et al. | |
| 10,331,054 | B2 | 6/2019 | Urushihara et al. | |
| 10,642,186 | B2 | 5/2020 | Sakurai et al. | |
| 2013/0302070 | A1 * | 11/2013 | Oosaku | G03G 15/0808 399/286 |
| 2017/0248867 | A1 | 8/2017 | Sakurai | |
| 2018/0101106 | A1 | 4/2018 | Takeno | |
| 2019/0265609 | A1 * | 8/2019 | Sakurai | G03G 15/0808 |
| 2020/0041926 | A1 * | 2/2020 | Ishida | G03G 15/162 |
| 2020/0073309 | A1 * | 3/2020 | Matsunaga | G03G 21/1814 |
| 2020/0096898 | A1 * | 3/2020 | Utsuno | G03G 21/1814 |
| 2020/0201203 | A1 | 6/2020 | Ito et al. | |

FOREIGN PATENT DOCUMENTS

| | | |
|---|---|---|
| JP | H06-130792 | 5/1994 |
| JP | H07-160113 | 6/1995 |
| JP | H10-097134 | 4/1998 |
| JP | 2013-083718 | 5/2013 |
| JP | 2015-132692 | 7/2015 |

* cited by examiner

DEVELOPING MEMBER, ELECTROPHOTOGRAPHIC PROCESS CARTRIDGE, AND ELECTROPHOTOGRAPHIC IMAGE FORMING APPARATUS

BACKGROUND OF THE INVENTION

Field of the Invention

The present disclosure relates to an electrophotographic developing member, and is directed to an electrophotographic process cartridge and an electrophotographic image forming apparatus.

Description of the Related Art

Known image forming methods for electrophotographic image forming apparatuses such as copiers, fax machines, and printers include a developing method using a magnetic one-component toner or a non-magnetic one-component toner. Specifically, an electrophotographic photosensitive member, which is a rotatable electrostatic latent image bearing member, is charged by a charging unit such as a charging roller, and the charged surface of the photosensitive member is exposed to laser light to form an electrostatic latent image.

In the next step, in the electrophotographic process cartridge for the image forming apparatus, a toner in a toner container is applied onto a developing member by a toner feed roller, and the applied toner is regulated by a toner regulating member to form a toner layer. Thereafter, the electrostatic latent image is developed with the toner in the contact portion between the photosensitive member and the developing member. Subsequently, the toner image on the photosensitive member is transferred onto a recording sheet through or not through an intermediate transfer belt in a transfer unit. The toner image is fixed onto the recording sheet with heat and pressure in a fixing apparatus. The recording sheet having the fixed image is discharged to the outside of the image forming apparatuses.

In such an image forming method, the developing apparatus includes the following electrophotographic members:

(1) a toner feed roller which is present within a toner container, feeds a toner to the developing member, and scrapes the toner after development from the developing member;

(2) a toner regulating member which forms a toner layer on the developing member and controls the toner on the developing member to a predetermined amount; and (3) a developing member which is disposed to close the opening of a toner container which accommodates the toner, is partially exposed to the outside of the container with the exposed portion facing the photosensitive member, and develops the toner to the photosensitive member.

These electrophotographic members rotate or slide to perform the development.

Japanese Patent Application Laid-Open No. H07-160113 discloses a toner carrier (developing member) including dielectric portions having a high electric resistance in the surface of an electroconductive portion, wherein a toner is electrically adsorbed by the charged dielectric portions to carry the toner.

Japanese Patent Application Laid-Open No. H06-130792 discloses a developing apparatus including a developer carrier having a mixed distribution of dielectric substance portions and conductor portions on the surface thereof, and a developer charging unit, wherein a toner layer with a desired deposit amount and charge amount can be formed on the surface of the developer carrier (developing member) without a toner feed roller, and can be fed to an image bearing member.

The present inventors, who have conducted extensive research, have found that the amount of the toner carried varied depending on the surrounding temperature and humidity in the developing members according to Japanese Patent Application Laid-Open Nos. H07-160113 and H06-130792 in some cases. Specifically, the toner carrying ability was reduced under an environment at a high temperature and a high humidity such as a temperature of 30° C. and a relative humidity of 80%, compared to an environment at normal temperature and normal humidity such as a temperature of 23° C. and a relative humidity of 50%.

SUMMARY OF THE INVENTION

One aspect of the present disclosure is directed to providing a developing member having a toner carrying ability having low environmental dependency. Another aspect of the present disclosure is directed to providing an electrophotographic process cartridge and electrophotographic image forming apparatus which can stably form high-quality electrophotographic images.

According to first aspect of the present disclosure, there is provided an electrophotographic developing member comprising:

a substrate having an electroconductive outer surface;

an electrically insulating resin layer on the electroconductive outer surface of the substrate; and electrically insulating domains on an outer surface of the electrically insulating resin layer, the electrophotographic developing member having an outer surface including a surface of the electrically insulating resin layer and surfaces of the electrically insulating domains, wherein when the surfaces of the domains constituting the outer surface of the developing member are electrically charged so as to have potential of $V_0$ (V), a potential decay time constant defined as a period of time necessary for a potential of each of the surfaces of the domains to decay to $V0\times(1/e)$ (V) is 60.0 seconds or longer, and when the surface of the electrically insulating resin layer constituting the outer surface of the developing member is electrically charged so as to have a potential of $V_0$ (V), a potential decay time constant defined as a period of time necessary for a potential of the surface of the electrically insulating resin layer to decay to $V_0\times(1/e)$ (V), is shorter than 6.0 seconds, and wherein assuming that the electrically insulating domains are orthographically projected onto the electroconductive outer surface of the substrate, to obtain projection images of the respective electrically insulating domains, each of areas of the projection images is defined as S, and each of areas of convex envelopes of the projection images is defined as H, at least one of the domains satisfies the relationship represented by Expression (1):

$$0.05 \leq S/H \leq 0.80. \quad \text{Expression (1)}$$

According to another aspect of the present disclosure, there is provided an electrophotographic developing member comprising:

a substrate having an outer surface containing a metal; and electrically insulating domains directly disposed on the outer surface of the substrate, the electrophotographic developing member having an outer surface including the outer surface of the substrate, and surfaces of the electrically insulating domains, wherein when the surfaces of the domains constituting the outer surface of the developing member are electrically charged so as to have potential of $V_0$ (V), a potential decay time constant defined as a period of time necessary for a potential of each of the surfaces of the domains to decay to $V_0 \times (1/e)$ (V) is 60.0 seconds or longer, and wherein assuming that the electrically insulating domains are orthographically projected onto the electroconductive outer surface of the substrate, to obtain projection images of the respective electrically insulating domains, each of areas of the projection images is defined as S, and each of areas of convex envelopes of the projection images is defined as H, at least one of the domains satisfies the relationship represented by Expression (1):

$$0.05 \leq S/H \leq 0.80. \quad \text{Expression (1)}$$

According to further aspect of the present disclosure, there is provided an electrophotographic process cartridge configured to be detachably attachable to a body of an electrophotographic image forming apparatus, the electrophotographic process cartridge including a toner container containing a toner, and a developing unit which carries the toner, wherein the developing unit includes one of the developing members described above.

According to still further aspect of the present disclosure, there is provided an electrophotographic image forming apparatus including an electrophotographic photosensitive member, a charging unit disposed to be capable of charging the electrophotographic photosensitive member, and a developing unit that feeds a toner to the electrophotographic photosensitive member, wherein the developing unit includes one of the developing members described above.

Further features of the present disclosure will become apparent from the following description of exemplary embodiments with reference to the attached drawings.

BRIEF DESCRIPTION OF THE DRAWINGS

FIG. 1A is a diagram showing a configuration of a developing member including a substrate having an electroconductive outer surface and a plurality of electrically insulating domains disposed on an outer surface of the substrate with an insulating resin interposed. FIG. 1B is a diagram showing a configuration of a developing member including a substrate having an outer surface containing a metal, and a plurality of electrically insulating domains disposed directly on the outer surface.

FIG. 3A is a diagram showing an orthographically projected image of the insulating domain. FIG. 3B is a diagram showing the relationship between the orthographically projected image of the insulating domain and the convex envelope thereof. FIG. 3C is a diagram showing only the convex envelope.

FIG. 4A is a diagram showing the insulating domain without a non-insulating domain-coated portion, the insulating domain being surrounded by the convex envelop of the insulating domain of the developing member. FIG. 4B is a diagram showing the insulating domain having a non-insulating domain-coated portion, the insulating domain being surrounded by the convex envelop of the insulating domain of the developing member.

DESCRIPTION OF THE EMBODIMENTS

Figure 1A:
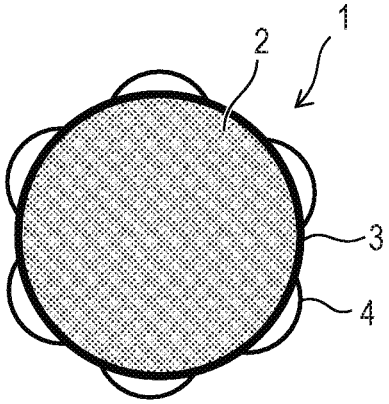
FIGS. 1A and 1B are cross-sectional views of an electrophotographic developing member according to one aspect of the present disclosure.

The present inventors infer the reason why the developing members according to Japanese Patent Application Laid-Open Nos. H07-160113 and H06-130792 have a toner carrying ability which readily varies according to the environment under which the developing member is placed, as follows.

In other words, the developing members according to Japanese Patent Application Laid-Open Nos. H07-160113 and H06-130792 each include dielectric portions and electroconductive portions on the surface thereof. When toner particles roll on such a surface, dielectric portions are charged. A gradient force acts on the toner particles due to closed microelectric fields formed between the dielectric portions and the electroconductive portions to attract the toner particles to the dielectric portions. For this reason, the gradient force also varies when the conductivity of the dielectric portions varies according to the surrounding environment. For example, the electric resistance of the dielectric portions reduces under an environment at a high temperature and a high humidity, obstructing charge of the dielectric portions. This results in a reduction in gradient force and thus a reduction in toner particles attracted to the dielectric portions. As a result, an amount of carried toner particles is reduced.

The present inventors have conducted further research to obtain a developing member which provides a reduced environmental dependency of the amount of carried toner particles. As a result, the present inventors have found that an electrophotographic developing member having the following configuration can well achieve the above object.

According to a first aspect of the electrophotographic developing member according to the present disclosure, provided is an electrophotographic developing member including:

a substrate having an electroconductive outer surface; an insulating resin layer on the electroconductive outer surface of the substrate; and electrically insulating domains on an outer surface of the insulating resin layer, the electrophotographic developing member having an outer surface including a surface of the insulating resin layer and surfaces of the electrically insulating domains, wherein when the surfaces of the domains constituting the outer surface of the developing member are electrically charged so as to have potential of $V_0$ volt (V), a potential decay time constant defined as a period of time necessary for a potential of each of the surface of the domains to decay from $V_0$ volt to V0×(1/e) (V) is 60.0 seconds or longer, and when the surface of the electrically insulating layer constituting the outer surface of the developing member is electrically charged so as to have a potential of $V_0$ (V), a potential decay time constant defined as a period of time necessary for a potential of the surface of the electrically insulating resin layer to decay from $V_0$ (V) to $V_0$×(1/e) (V), is shorter than 6.0 seconds, and wherein assuming that the electrically insulating domains are orthographically projected onto the electroconductive outer surface of the substrate, to obtain projection images of the respective electrically insulating domains, each of areas of the projection images is defined as S, and each of areas of convex envelopes of the projection images is defined as H, at least one of the domains satisfies the relationship represented by Expression (1):

$$0.05 \leq S/H \leq 0.80. \quad \text{Expression (1)}$$

According to a second aspect of the electrophotographic developing member according to the present disclosure, provided is an electrophotographic developing member including:

a substrate having an outer surface containing a metal; and electrically insulating domains directly disposed on the outer surface of the substrate, the electrophotographic developing member having an outer surface including the outer surface of the substrate, and surfaces of the electrically insulating domains, wherein when the surfaces of the domains constituting the outer surface of the developing member are electrically charged so as to have potential of $V_0$ (V), a potential decay time constant defined as a period of time necessary for a potential of each of the surfaces of the domains to decay from $V_0$ (V) to $V_0$×1/e) (V) is 60.0 seconds or longer, and wherein assuming that the electrically insulating domains are orthographically projected onto the electroconductive outer surface of the substrate, to obtain projection images of the respective electrically insulating domains, each of areas of the projection images is defined as S, and each of areas of convex envelopes of the projection images is defined as H, at least one of the domains satisfies the relationship represented by Expression (1):

$$0.05 \leq S/H \leq 0.80. \quad \text{Expression (1)}$$

<<Developing Member>>

<Configuration of Developing Member>

FIG. 1A is a cross-sectional view of a developing member according to a first aspect of the present disclosure taken along a direction orthogonal to the longitudinal direction. The developing member according to this aspect includes a substrate having an electroconductive outer surface, and insulating domains disposed thereon with an electrically insulating resin layer interposed.

Figure 1B:
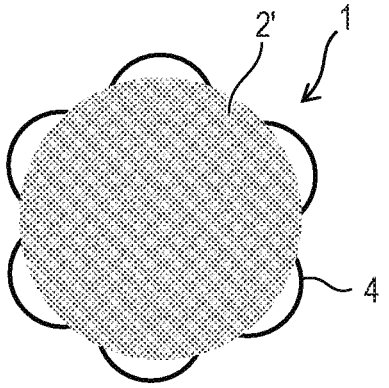

FIG. 1B is a cross-sectional view of a developing member according to a second aspect of the present disclosure taken along a direction orthogonal to the longitudinal direction. The developing member according to this aspect includes a substrate having an outer surface containing a metal, and insulating domains disposed directly on the substrate.

Here, the outer surface of the developing member typically refers to a surface in contact with other members (such as a toner and a toner regulating member). In other words, the outer surface includes the outer surfaces of the insulating domains (hereinafter, also referred to "insulating domain-coated portions") and an outer surface portion not coated with the insulating domain (hereinafter, also referred to as "non-insulating domain-coated portion"). Specific examples thereof include a configuration as shown in FIG. 1A in which a developing member 1 includes a substrate 2 having an electroconductive outer surface, an electrically insulating resin layer 3 on the substrate 2, and insulating domains 4 present on the outer surface of the electrically insulating resin layer. As shown in FIG. 1B, the developing member may include a substrate 2' having an outer surface containing a metal, and insulating domains 4 disposed directly on the substrate 2'.

<Insulating Domain>

Figure 2:
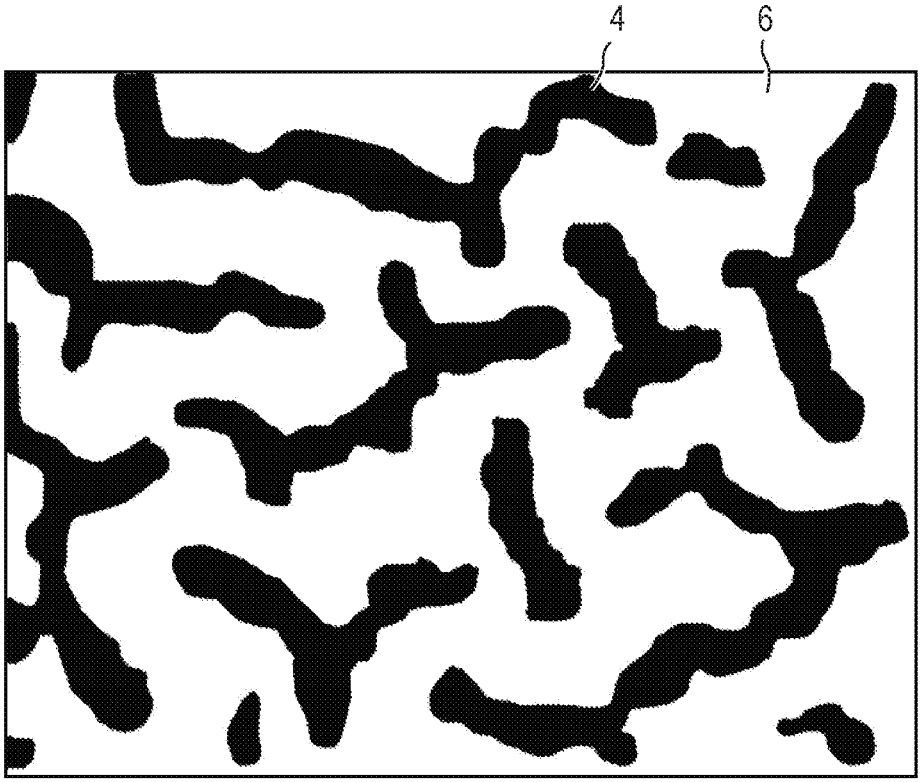
FIG. 2 is a partially enlarged view of the surface of a developing member according to one embodiment of the present disclosure.

FIG. 2 is a partially enlarged view of the surface of the developing member according to one aspect of the present disclosure. In FIG. 2, the surface of the developing member includes:

(i) a plurality of electrically insulating domains 4 independent from each other; and (ii) a non-insulating domain-coated portion 6 not coated with the insulating domains 4. The domain has a volume resistivity of $1.0\times10^{13}$ Ω·cm or more and $1.0\times10^{18}$ Ω·cm or less, for example. The electroconductive portion has a volume resistivity of $1.0\times10^{12}$ Ω·cm or less, for example, $1.0\times10^{11}$ Ω·cm or less in particular.

<Mechanism to Demonstrate Effects>

Figure 3A:
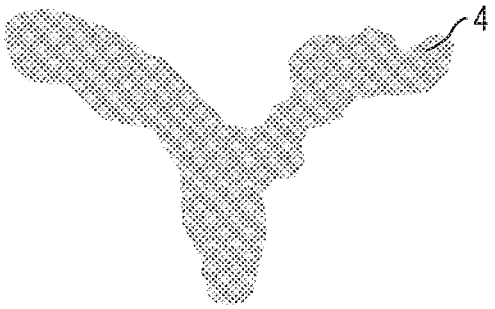
FIGS. 3A, 3B, and 3C are diagrams illustrating the insulating domain of the developing member according to one embodiment of the present disclosure.
Figure 3B:
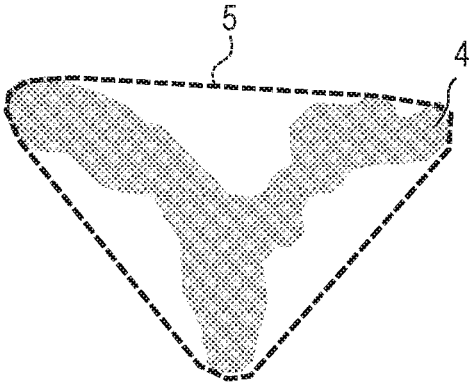
Figure 3C:
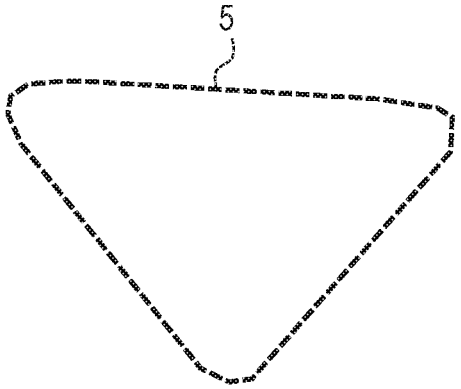

FIG. 3A shows an orthographically projected image of a single domain 4. FIG. 3B shows the convex envelope 5 of the domain. The domain according to this aspect has a value of S/H of 0.05 or more and 0.80 or less, wherein the area of the domain 4 is S and the area of the convex envelope 5 is H. Hereinafter, "S/H" is also referred to as "solidity".

A domain having such a shape can increase the amount of toner particles carried by the developing member for the following reason inferred by the present inventors.

In the developing member according to this aspect, electric fields are generated between the insulating domains and the surface of the electroconductive portion as a result of rolling of the toner particles on the surface of the developing member to charge the domains. As a result, a gradient force acts on the toner particles present around the domains, and the toner particles are adsorbed to the domains.

Figure 4A:
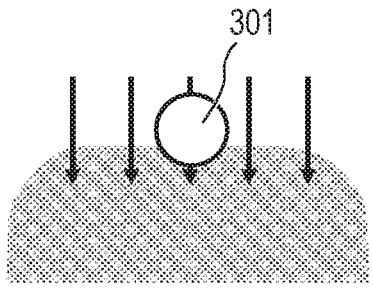
FIGS. 4A and 4B are diagrams showing a mechanism to demonstrate the effects of the electrophotographic developing member according to one aspect of the present disclosure.

Here, in the domain having a shape shown in FIG. 4A, the toner particle attracted to the domain as a result of the action of the gradient force is substantially only a toner particle 301 present near the outer edge of the domain.

Figure 4B:
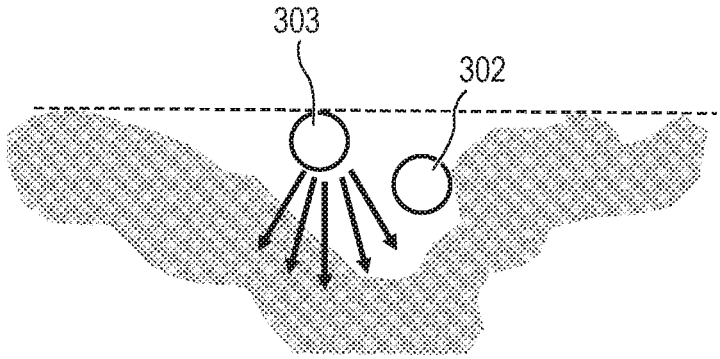

In contrast, in the domain having a shape according to this aspect, as shown in FIG. 4B, the gradient force can act on a toner particle 302 present near the outer edge of the domain and a toner particle 303 present in the exposed portion of the electroconductive portion located between the outer edge of the domain and the convex envelope 5. It is considered that this is because a dense electric field is formed in the region between the outer edge of the domain and the convex envelope 5. As a result, the number of toner particles attracted to the domain can be increased. Because such an increase in the number of toner particles attracted to the domain increases the number of toner particles rolling on the surface of the domain, the charge amount of the domain can be relatively increased to compensate for a reduction in charge amount attributed to a reduction in electric resistance of the domain under an environment at a high temperature and a high humidity. As a result, such a reduction in toner carrying ability under an environment at a high temperature and a high humidity as observed in the developing members according to Japanese Patent Application Laid-Open Nos. H07-160113 and H06-130792 can be suppressed.

The domain, which has a different form from that of the surface of the electroconductive portion, can be captured as a difference in intensity of the reflectance, and can be distinguished with an optical microscope or an electron microscope. Because the insulating domain has a resistivity different from that of the electroconductive portion, the domain can be more clearly distinguished using a combination of an electrostatic force microscope (EFM) therewith. For example, DIGITAL MICROSCOPE VHX-5000 (trade name, manufactured by KEYENCE CORPORATION) can be used as an optical microscope, JSM-7800 FPRIME (trade name, manufactured by JEOL, Ltd.) can be used as an electron microscope, and MODEL 1100TN (trade name, manufactured by Trek Japan K.K.) can be used as an electrostatic force microscope.

The observed image above is binarized to determine the solidity S/H. Binalization can be easily performed by selecting the optical condition in the optical microscope to generate a large difference in intensity of the reflectance between the insulating domain and the electroconductive portion. Here, the convex enveloped area H of the orthographically projected image of the insulating domain can be measured using image processing software commercially available or usually used. The convex envelope may be calculated by a known method, such as a known Quickhull algorithm or a Graham's scan algorithm, as long as it can generate a convex envelope. The value of S/H can be calculated using image processing software commercially available or usually used. Such image processing software to be used is Image J ver. 1.45 (developed by Wayne Rasband National Institutes of Health, NIH).

In the developing member, it is preferred that 20% by number or more, preferably 40% by number or more, more preferably 60% by number or more of domains of the total number of domains satisfy the relationship represented by Expression (1). This is because this further reduces the environmental dependency of the amount of toner particles carried.

In the developing member, the number proportion of insulating domains falling within the range represented by Expression (1) can be determined using a variety of microscopes and image processing software as described above.

In the developing member, the domains having an area S in the range of 300 $\mu m^2$ or more and 100000 $\mu m^2$ or less occupy preferably 80% by number or more of the insulating domains. If the area S is 300 $\mu m^2$ or more, the surface of the electroconductive portion surrounded with a convex envelop for a toner has a sufficiently large area for the toner, facilitating the effects of the present disclosure. If the area S is 100000 $\mu m^2$ or less, excessively charged insulating domains barely cause image defects such as dots images. Thus, by controlling the domains having an area S within the range above to 80% by number or more, a high toner carrying ability can be provided both under an environment at a low temperature and a low humidity and under an environment at a high temperature and a high humidity and excessive charge of the developing member can be suppressed.

Figure 5:
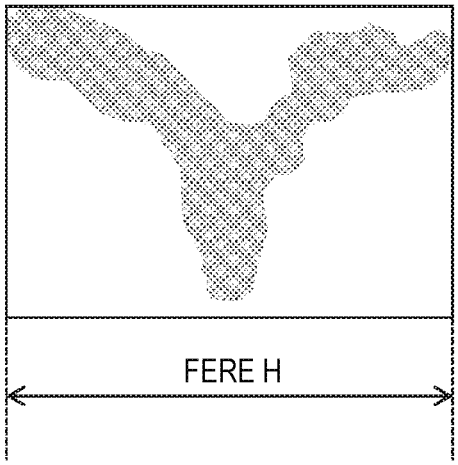
FIG. 5 is a diagram showing one example of the horizontal Feret's diameter of the orthographically projected image of the insulating domain in the electrophotographic developing member according to one aspect of the present disclosure.

In the developing member, it is preferred that the arithmetic average of the horizontal Feret's diameters of the insulating domains be 100 μm or more and 2000 μm or less. FIG. 5 is a drawing one example of a horizontal Feret's diameter of an orthographically projected image of an insulating domain in the developing member. The horizontal direction in FIG. 5 indicates the longitudinal direction of the developing member. As shown in FIG. 5, a rectangle circumscribing the orthographically projected image of the insulating domain is drawn such that one of sides thereof is parallel to the longitudinal direction of the developing member, and the length of the side is defined as a horizontal Feret's diameter. If the arithmetic average of the horizontal Feret's diameters is 100 μm or more, the toner adsorbed to the insulating domains generates mechanical carrying force to enhance the toner carrying ability. If the arithmetic average of the horizontal Feret's diameters is 2000 μm or less, excessively charged insulating domains barely cause image defects such as dots images.

In the developing member, it is preferred that the total of the areas S of the domains present in a rectangular region on the outer surface where the side in the longitudinal direction is 3.0 mm and the side in the circumferential direction is 1.0 mm be 15% or more and 50% or less of the area of the rectangular region. By controlling the total within this range, a high toner carrying ability can be provided both under an environment at a low temperature and a low humidity and under an environment at a high temperature and a high humidity, and excessive charge of the developing member can be suppressed.

Each of a plurality of insulating domains preferably has a thickness of 0.1 μm or more and 10.0 μm or less. Control of the thickness to 0.1 μm or more facilitates charge of the insulating domains while control of the thickness to 10.0 μm or less facilitates suppression of excessive charge of the insulating domains. More preferably, the insulating domains have a thickness of 0.5 μm or more and 3.0 μm or less.

<Charging Properties of Outer Surface of Developing Member>

The presence of the insulating domain-coated portions and the non-insulating domain-coated portion on the outer surface of the developing member can be verified by observing two or more regions on the outer surface of the developing member using an optical microscope or a scanning electron microscope.

Furthermore, that the insulating domain has electrical insulation and the non-insulating domain-coated portion has a conductivity higher than that of the insulating domain can be verified by charging the outer surface of the developing member containing the insulating domain-coated portions and the non-insulating domain-coated portion, and measuring the residual potential distribution. The residual potential distribution can be verified by sufficiently charging the outer surface of the developing roller using a charging apparatus such as a corona discharge apparatus and measuring the residual potential distribution of the charged outer surface of the developing roller using an electrostatic force microscope (EFM) or a surface potential microscope (KFM), for example.

The electrical insulation of the insulating domain forming the insulating domain-coated portions and the conductivity of the non-insulating domain-coated portion can also be evaluated according to the potential decay time constant (hereinafter, also referred to as "time constant") of the residual potential in addition to the volume resistivity. The time constant of the residual potential indicates a time needed for decay of the residual potential to 1/e of the initial value, i.e. $V_0$ volt (V), and serves as an index indicating easiness of retention of the charged potential. Here, e is the base of the natural logarithm.

In the outer surface of the developing member, the insulating domain-coated portion, i.e. each of the surfaces of the insulating domains, has a time constant of 60.0 seconds or longer. This case is preferred because the insulating domain-coated portions are quickly charged and the potential due to charge is readily retained. In contrast, if the outer surface of the developing member according to the present disclosure includes the electrically insulating resin layer in the non-insulating domain-coated portion, the non-insulating domain-coated portion, i.e. the surface of the electrically insulating resin layer constituting the outer surface of the developing member, has a time constant of less than 6.0 seconds. This case is preferred because charge of the non-insulating domain-coated portion is suppressed to facilitate generation of a difference in potential between the non-insulating domain-coated portion and the charged insulating domain-coated portions and thus demonstration of the gradient force.

If the outer surface of the developing member contains a metal, such a surface has high conductivity. Thus, the residual potential is approximately 0 V in the start of measurement of the time constant at the present disclosure by the following method for measurement. This corresponds to the case where the potential completely decays at the start of the measurement. This case is also preferred because a suitable difference in potential between the non-insulating domain-coated portions and the insulating domain-coated portion is readily generated to demonstrate the gradient force.

The time constant of the residual potential can be determined, for example, by sufficiently charging the outer surface of the developing roller using a charging apparatus such as a corona discharge apparatus, and measuring the time transitions of the residual potential in the insulating portion and the electroconductive portion on the charged outer surface of the developing roller using an electrostatic force microscope (EFM).

Here, the outer surface of the electrophotographic developing member is typically the surface of the electrophotographic developing member in contact with other members (such as a toner, a toner feed roller, and a toner regulating member).

The insulating domain-coated portion preferably has a volume resistivity of $1\times10^{14}$ Ω·cm or more and $1\times10^{17}$ Ω·cm or less. A volume resistivity within this range facilitates charge of the insulating domains. The non-insulating domain-coated portion preferably has a volume resistivity of $1\times10^{10}$ Ω·cm or less.

<Method of Producing Developing Member>

Examples of the method of forming the domain include a method of applying a material for forming the domain onto the surface of a substrate using a printing method such as an ink jet method or a screen printing method, and a method of wet coating a material for forming the domain (coating material) onto the electrically insulating resin layer by a coating method such as spraying or dipping if the electrically insulating resin layer is interposed.

If the ink jet method is used, the coating material for forming the domain is applied onto the surface of the substrate such that the value of S/H is 0.05 to 0.80.

If the wet coating method such as spraying or dipping is used, for example, the coating material for forming the domain is applied onto the electrically insulating resin layer, and the coating material is repelled on the surface of the electrically insulating resin layer to form domains having a value of S/H of 0.05 to 0.80. The formation of domains having a predetermined shape by repelling the coating material on the surface of the electrically insulating resin layer can be controlled, for example, through adjustment of the contact angle of the coating material to the surface of the electrically insulating resin layer, adjustment of the molecular weight of solid contents in the coating material, and selection of the type of the solvent in the coating material.

In general, compared to spraying, dipping can be used even in coating materials prepared to have a relatively high viscosity and high solid contents, and can be used in formation of domains suitable for the present disclosure.

The contact angle of the coating material to the electrically insulating resin layer is preferably 10° or more and 90° or less, more preferably 20° or more and 50° or less. Control of the contact angle to 10° or more facilitates formation of domains independent of each other without forming a uniform film. Control of the contact angle to 90° or less facilitates formation of domains having a surface shape whose value of S/H is within the range of 0.05 to 0.80.

The material for forming the domain has a molecular weight of preferably 2500 or more, more preferably 10000 or more. A higher molecular weight facilitates the appropriate repelling of the coating material applied onto the electrically insulating resin layer, providing a value of S/H within the range of 0.05 to 0.80.

Furthermore, a solvent having a boiling point of 50° C. or more and 200° C. or less is selected as the solvent for the coating material. Such a solvent can control the drying rate of the coating material on the electrically insulating resin layer to easily control the area S of the domain. Specifically, a higher boiling point can delay the drying of the coating material to increase the area S. Examples of the solvent include acetone (boiling point of 56.1° C.), methanol (boiling point of 64.5° C.), hexane (boiling point of 68.7° C.), ethanol (boiling point of 78.3° C.), methyl ethyl ketone (MEK, boiling point of 79.6° C.), cyclohexane (boiling point of 80.7° C.), heptane (boiling point of 98.4° C.), toluene (boiling point of 110.6° C.), methyl isobutyl ketone (MIBK, boiling point of 116.2° C.), and diisobutyl ketone (DIBK, boiling point of 168.4° C.).

Among these, suitably used are acetone, MEK, and MIBK from the viewpoint of the solubility of the material forming the domain and the viscosity of the solution.

The drying rate may be controlled by adding a liquid component other than the solvent, such as a monomer, for example.

The horizontal Feret's diameter of the domain can be controlled with the surface roughness (Ra) of the substrate. For example, the horizontal Feret's diameter can be reduced by increasing the surface roughness of the substrate. Examples of such surface roughening of the substrate include blasting treatment described in Japanese Patent Application Laid-Open No. H10-97134.

The substrate has a cylindrical or hollow cylindrical shape, and is composed of an electroconductive material as follows: metals and alloys such as aluminum, copper alloy, stainless steel, and free cutting steel; iron plated with chromium or nickel; and synthetic resins having conductivity. A known adhesive may be applied onto the surface of the substrate in the range not impairing the effects of the present disclosure to enhance the adhesiveness to the insulating domains disposed on the outer peripheral surface thereof.

Examples of the material forming the insulating domain include resins and metal oxides. Among these, preferred are resins which facilitate charge of the insulating domains.

Specific examples of the resins include: acrylic resins, polyolefin resins, epoxy resins, and polyester resins.

Among these, preferred are acrylic resins because these can facilitate control of the volume resistivity of the domain within the range specified above. Examples of the acrylic resin specifically include polymers and copolymers prepared using the following monomers as raw materials: methyl methacrylate, 4-tert-butylcyclohexanol acrylate, stearyl acrylate, lauryl acrylate, 2-phenoxyethyl acrylate, isodecyl acrylate, isooctyl acrylate, isobornyl acrylate, 4-ethoxylated nonylphenol acrylate, and ethoxylated bisphenol A diacrylate.

The non-insulating domain-coated portion may include an electrically insulating resin layer. The electrically insulating resin layer can be composed of any material, and suitably used are acrylic resins, epoxy resins, silicone resins, and urethane resins from the viewpoint of the polarity of the surface and the adhesion to the substrate. A combination of these may be used in the range not impairing the effects of the present disclosure.

The developing member can be used both in non-contact developing apparatuses and contact developing apparatuses using magnetic one-component developers or non-magnetic one-component developers and developing apparatuses using two-component developers.

<<Developing Blade Member>>

A developing blade will be described as an example of the developing member according to another aspect of the present disclosure. The developing blade member is produced, for example, through a step of mixing raw materials under stirring using a mold cavity defined by a molding drum having a molding groove continuously formed on its outer peripheral surface and an endless belt in contact with the outer peripheral surface of the molding drum, a step of injecting the resulting mixture, a step of curing the mixture under heating with the sandwiching portion between the molding drum and the endless belt, a step of releasing the molded body after curing under heating from the molding drum and the endless belt, and a step of cutting the molded body into a predetermined size.

[Raw Materials]

Examples of the raw materials include polyisocyanates and polyols which form urethane resins. Preferably, the followings are used:

(A) a polyisocyanate;

(B) an adipate polyester polyol having a number average molecular weight of 1000 to 4000;

(C) a chain extender having a molecular weight of 200 or less; and (D) 20 ppm or more and 500 ppm or less of an isocyanurating catalyst and 200 ppm or more and 1500 ppm or less of a urethanization catalyst.

Specifically, examples of the (A) polyisocyanates can include 4,4'-diphenylmethane diisocyanate (MDI), isophorone diisocyanate (IPDI), 4,4'-dicyclohexylmethane diisocyanate (hydrogenated MDI), trimethylhexamethylene diisocyanate (TMHDI), tolylene diisocyanate (TDI), carbodiimide-modified MDI, polymethylenephenyl polyisocyanate (PAPI), orthotoluidine diisocyanate (TODI), naphthylene diisocyanate (NDI), xylene diisocyanate (XDI), hexamethylene diisocyanate (HMDI), paraphenylene diisocyanate (PDI), lysine diisocyanate methyl ester (LDI), and dimethyl diisocyanate (DDI). These can be used alone or in combination. Among these, particularly preferred is use of MDI.

Specifically, examples of the (B) adipate polyester polyol can include polyethylene adipate polyester polyol, polybutylene adipate polyester polyol, polyhexylene adipate polyester polyol, polyethylene-propylene adipate polyester polyol, polyethylene-butylene adipate polyester polyol, and polyethylene-neopentylene adipate polyester polyol. These polyols preferably have a number average molecular weight of 1000 to 4000. The amount of the adipate polyester polyol to be used is preferably 40 to 80% (in terms of % by mass) of the total mass of the molded body after curing.

The (C) chain extender to be used can be a polyol having a low molecular weight, such as glycol. Specifically, examples thereof can include ethylene glycol (EG), diethylene glycol (DEG), propylene glycol (PG), dipropylene glycol (DPG), 1,4-butanediol (1,4-BD), hexanediol (HD), 1,4-cyclohexanediol, 1,4-cyclohexanedimethanol, P-xylylene glycol (terephthalyl alcohol), and triethylene glycol. These can be used.

Besides the glycols, other polyhydric alcohols can be used. Examples thereof can include trimethylolpropane, glycerol, pentaerythritol, and sorbitol. These can be used alone or in combination. A chain extender having a molecular weight of 200 or less can increase the density of the hard segment to form a developing blade member having high mechanical properties. The amount of the chain extender to be used is preferably 2 to 15% (in terms of % by mass) of the total mass of the molded body after curing.

The (D) isocyanurating catalyst can promote the curing reaction to shorten the production time and reduce the size of the apparatus. This leads to an improvement in production efficiency and a reduction in cost of the apparatus. An isocyanurating catalyst having temperature sensitivity can delay the reaction at room temperature and can promote curing by heating. The amount of the isocyanurating catalyst to be used is preferably 20 ppm or more and 500 ppm or less in the raw materials. If the amount of the isocyanurate catalyst to be used is 20 ppm or more, the curing reaction can be promoted; and if the amount is 500 ppm or less, start of the curing reaction during the step of mixing raw materials under stirring can be suppressed.

Examples of the isocyanurating catalyst to be used can include tertiary amines such as N-ethylpiperidine, N,N'-dimethylpiperazine, and N-ethylmorpholine; hydroxides and organic weak acid salts of tetraalkylammonium such as tetramethylammonium, tetraethylammonium, and tetrabutylammonium; hydroxides and organic weak acid salts of hydroxyalkylammonium such as trimethylhydroxypropylammonium and triethylhydroxypropylammonium; and metal salts of carboxylic acids such as acetic acid, propionic acid, butyric acid, caproic acid, capric acid, valeric acid, octylic acid, myristic acid, and naphthenic acid. These can be used alone or in combination. Among these, preferred are metal salts of carboxylic acids because they have temperature sensitivity to start the curing reaction by heating and do not affect other parts due to blooming after molding.

Use of a urethanization catalyst can provide a developing blade member having appropriate properties needed for the developing blade member such as elasticity, flexibility, mechanical strength, and friction resistance. The amount of the urethanization catalyst is preferably 200 ppm or more and 1500 ppm or less, more preferably 300 ppm or more and 1000 ppm or less in the raw materials. If the amount of the urethanization catalyst to be used is 200 ppm or more, the urethanization reaction can be promoted to provide a developing blade member having properties needed for the developing blade member. If the amount is 1500 ppm or less, start of the urethanization reaction during the step of mixing the raw materials under stirring can be suppressed.

Examples of the urethanization catalyst to be used can include amino alcohols such as dimethylethanolamine; trialkylamines such as triethylamine; tetraalkyldiamines such as N,N,N',N'-tetramethyl-1,3-butanediamine; triethylenediamine; piperazine catalysts; triazine catalysts; and metal catalysts such as dibutyltin dilaurate. These can be used alone or in combination.

[Method of Producing Developing Blade, Production Apparatus]

Figure 6:
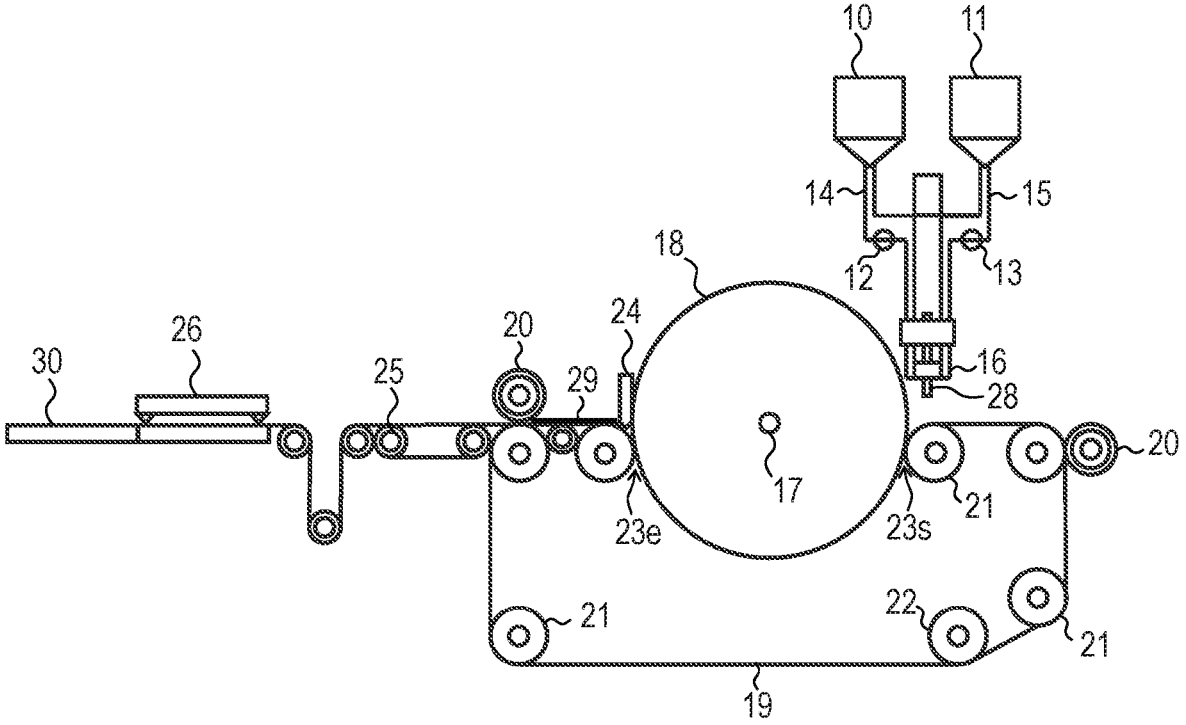
FIG. 6 is a schematic block diagram showing one aspect of an apparatus of producing a developing blade.

An embodiment of the method of producing a developing blade used in the present disclosure as well as the production apparatus will now be described with reference to the drawings. FIG. 6 is a schematic view illustrating one example of an apparatus for producing a developing blade member for an electrophotographic apparatus.

(Weighing, Mixing, and Stirring)

First, a polyurethane composition is weighed, and is mixed under stirring to prepare a mixture. As shown in FIG. 6, the apparatus for mixing the polyurethane composition under stirring includes at least two tanks 10 and 11. The tanks have tank outlets connected to a mixing head 16 through measuring pumps 12 and 13. The mixing head 16 is connected to the tanks 10 and 11 through ejection and circulation pipes 14 and 15. Furthermore, the mixing head 16 includes a stirring rotor in a chamber having a liquid inlet and an ejection port. The apparatus has such a known structure, and can eject the polyurethane composition with high precision. Using a quantitating mixer, a predetermined amount of the polyurethane composition is fed to the mixing head through the measuring pumps, and is homogeneously mixed under stirring.

(Injection)

Figure 7:
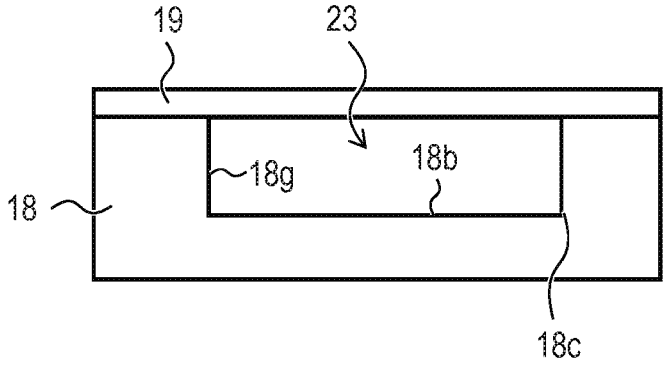
FIG. 7 is a cross-sectional view of one aspect of a molding cavity used in the production of the developing blade.

Next, in the configuration shown in FIG. 7, a molding apparatus includes a molding drum 18 having a molding groove for a crude product of the developing blade member which is continuously disposed on the outer peripheral surface in the rotational direction and has a lateral surface 18*g* and a bottom surface 18*b*; and an endless belt 19 disposed on part of the outer peripheral surface of the molding drum 18 to cover the lateral surface 18*g* of the molding groove. The molding apparatus also includes a heater built in or disposed near the molding drum 18 or disposed in a pressure welded portion between the molding drum 18 and the endless belt 19, the portion being in close contact with or near the endless belt 19. The heater can heat and cure the polyurethane composition injected to the lateral surface 18*g* and the bottom surface 18*b* of the molding groove in a molding cavity 23 surrounded by the lateral surface 18*g* and the bottom surface 18*b* of the molding groove on the molding drum 18 and the endless belt 19 shown in FIG. 7.

The molding drum 18 is made of hard aluminum, iron, or stainless steel, for example. The central portion of the molding drum 18 is rotatably supported by a horizontally rotational axis 17, and is rotated at a predetermined rate by a driving apparatus.

Figure 8:
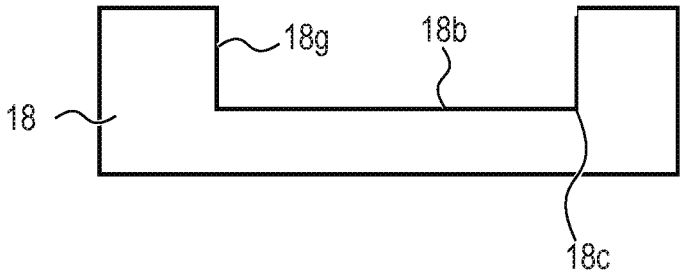
FIG. 8 is a cross-sectional view of one aspect of a molding groove of a molding drum used in the production of the developing blade.

The lateral surface 18*g* and the bottom surface 18*b* of the molding groove are continuously formed on the outer peripheral surface of the molding drum 18, and can have shapes appropriately selected according to the shape of the developing blade member for an electrophotographic apparatus produced. For example, FIG. 8 shows a cross-section having a rectangular shape. The bottom surface 18*b* of the molding groove serves as a surface contacting the developer carrier in a developing blade member after molding. The developing blade member is a member which frictionally charges the developer between the developer carrier and the developing blade member in the electrophotographic apparatus and regulates the amount of the developer to form the developer into a homogeneous thin layer. It is desired that a portion contacting the developer be surface roughened in at least a portion brought into contact with the developer carrier. Appropriate surface roughening enables uniform charge and carrying of the developer, suppressing image defects such as image stripes and unevenness of images.

Accordingly, it is preferred that at least the bottom surface 18*b* be surface roughened among the lateral surface 18*g* and the bottom surface 18*b* of the molding drum 18 for molding, the bottom surface 18*b* forming the surface of the developing blade member in contact with the developer. In such a configuration, if the produced developing blade member is used as a developer amount regulating blade, uniform charge and carrying of the developer can be enabled because at least the portion in contact with the developer carrier is surface roughened.

Examples of the method of surface roughening the bottom surface 18*b* of the molding drum 18 include physical methods. Specific examples of the physical methods include a method of surface roughening the surface of the molding drum 18 using sandpaper/a roughening film, a method of disposing sandpaper/a roughening film in the molding groove, and shot blasting methods such as sand blasting. Alternatively, surface roughening can be performed by a chemical method. Specific examples of the chemical method include etching, and a method of forming a coating film containing surface roughening fine particles. As the degree of surface roughening, a ten-point height of irregularities (RzJIS) of 4 to 8 μm is preferred. The ten-point roughness average (Rz) of the bottom surface 18*b* of the molding groove of the molding drum 18 and that of the charge control surface of the developing blade member were measured using a surface roughness analyzer SE3500 (manufacturer: Kosaka Laboratory Ltd.) according to JIS B 0601.

The endless belt 19 is composed of a metal band plate made of stainless steel, for example. The mechanism can be attained using a belt made of a resin other than stainless steel. In this case, use of a unit which can externally heat the resin belt is preferred.

The endless belt 19 extends on a driving roll 20 having a driving mechanism different from that of molding drum 18, a guide roll 21 which controls the travel of the endless belt, and a tension roll 22 which gives tension to the endless belt 19. The molding drum 18 and the endless belt 19 rotate at an identical circumferential speed.

It is preferred that the driving unit for the molding drum 18 and that for the endless belt 19 be separately disposed, because such a configuration can reduce the tension applied to the endless belt 19. As the driving unit, a combination of a motor, a clutch, and a brake can be considered. However, it is preferred that the molding drum 18 be driven by a motor and the endless belt 19 be driven by a powder brake and a motor to control the tension to the molding drum 18 and that to the endless belt 19 to be fixed according to the circumferential speed of the molding drum 18. The circumferential speed of the molding drum 18 and that of the endless belt 19 are preferably set in consideration of scratches of the endless belt 19 and the pattern of the molded article.

It is preferred that the tension of the tension roll 22 which applies tension to the endless belt 19 be less than or equal to the tension from the endless belt 19 pressed against the molding drum 18 in consideration of influences on the tension during driving of the endless belt 19 and bending of the endless belt 19.

(Heating Method)

The heating method of the heater is a method of heating the molding drum 18 externally or internally. Preferred is an internal heating method of directly heating the molding drum 18, because an external heating method is affected by disturbance (such as room temperature). The unit to perform internal heating includes heaters, oil, and water. Heaters are optimal from the viewpoint of space reduction and management of temperature. The temperature is desirably controlled to be less than or equal to a predetermined temperature±5 degrees in consideration of the abnormal appearance of the molded article.

Figure 10:
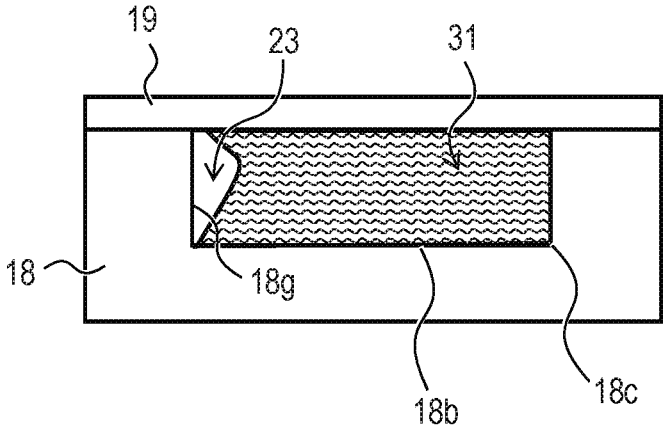
FIG. 10 is a diagram showing a state where the polyurethane composition is injected and sandwiched between the endless belt and the molding groove of the molding drum in the production of the developing blade.

In the apparatus shown in FIG. 6, the mixing head 16 as a unit to dispose raw materials includes an ejection port 28 which can eject the polyurethane composition at a predetermined rate. The polyurethane composition inside the mixing head 16 is ejected from the ejection port 28, and is disposed on the endless belt 19. At this time, the molding drum 18 and the endless belt 19 are rotating at predetermined rates. A space cavity 23 defined by the molding drum 18 and the endless belt 19 is shown in FIG. 7. The cavity 23 starts from the starting point 23*s* and ends at ending point 23*e* . An amount of the polyurethane composition not overflowing from the space cavity 23 is continuously injected along the lateral surface 18*g* of the molding groove on one side. FIG. 10 shows a state where the polyurethane composition 31 is injected and sandwiched between the endless belt 19 and the lateral surface 18*g* and bottom surface 18*b* of the molding groove of the molding drum 18. In the apparatus shown in FIG. 6, the position of the ejection port 28 is defined as the ejection position of the polyurethane composition.

[Position for Disposition]

In the injection step, the polyurethane composition is disposed at a position on the endless belt facing the molding groove upstream of the moving direction of the endless belt with respect to the initial contact portion between the molding drum 18 and the endless belt 19. The position is defined as a position for disposition.

Figure 9:
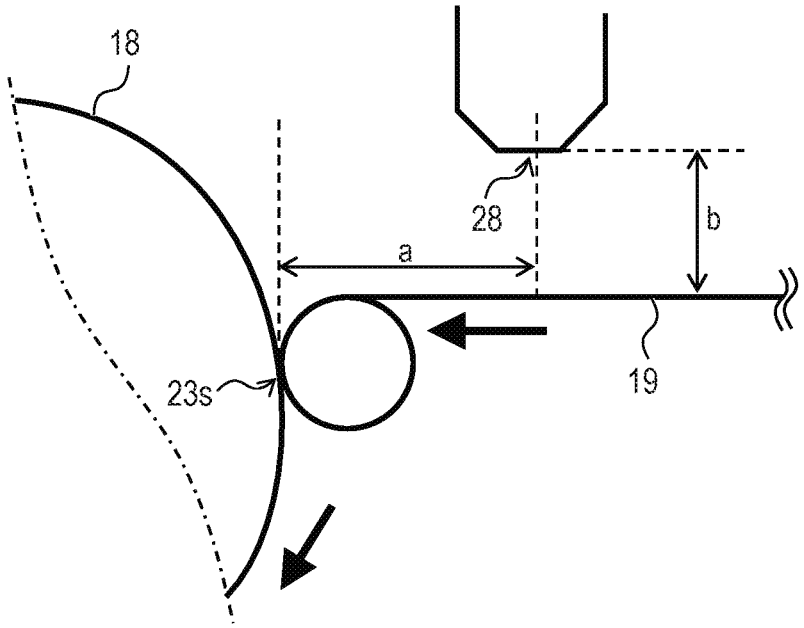
FIG. 9 is a diagram showing the ejection position of the polyurethane composition in the production of the developing blade.

It is preferred that the polyurethane composition be disposed at a position on the endless belt 19 located 50 mm or more and 350 mm or less upstream of the moving direction of the endless belt 19 with respect to the initial contact portion between the molding drum 18 and the endless belt 19, the position facing the molding groove (represented by a in FIG. 9). If the position is located less than 50 mm upstream thereof, the ejected polyurethane composition may cause mixing of air bubbles during injection or uneven injection, preventing production of a desired developing blade member in some cases. If the position is located more than 350 mm upstream thereof, the ejected polyurethane composition may spread across the width of the molding groove in the space, preventing production of a developing blade member having a desired dimension (thickness). The position for disposition in the present disclosure may be adjusted to the position on the endless belt 19 facing the molding groove. The adjustment method may be selected from known techniques such as cylinders, NCs, and mechanical stoppers.

[Ejection Position]

Here, the ejection port position (ejection position) 28 of the mixing head 16 of the quantitating mixer is preferably arranged at a position 3 mm or more and 30 mm or less above the endless belt 19 in the direction vertical to the position for disposition of the polyurethane composition (represented by b in FIG. 9). If the distance from the ejection position is less than 3 mm, the ejection port is likely to be in contact with the ejected polyurethane composition, causing fouling of the ejection port in some cases. As a result, foreign substances may be mixed with the injected polyurethane composition, obstructing the production of a high-quality developing blade member for an electrophotographic apparatus. If the polyurethane composition is ejected from a distance higher than 30 mm, the polyurethane composition is likely to be affected by the surrounding environment such as the air flow around the ejection port, causing swing of the ejected solution. For this reason, the polyurethane composition may be disposed deviated from the proper position corresponding to the molding groove on the endless belt 19, or air bubbles may be mixed with the polyurethane composition.

The curing reaction of the polyurethane composition is promoted by heating. Injection of the polyurethane composition onto the endless belt 19 without a heating mechanism does not promote the urethane polymerization reaction, which is accelerated by heat, and suppresses an increase in viscosity. After the endless belt 19 is brought into contact with the heated molding drum, the contact surface is immediately heated. When the polyurethane composition injected onto the endless belt 19 is transferred and filled into the molding groove of the molding drum 18, the polyurethane composition is heated and pressurized to start the urethane polymerization reaction. Thus, the polyurethane composition can be uniformly cured without unevenness. If the polyurethane composition is injected into the groove of the molding drum 18, the curing process progresses from the initial contact surface. For this reason, the curing process progresses in only the contact surface of the heated molding drum 18 ahead of other portions, generating a surface pattern caused by uneven curing of the contact surface of the endless belt 19 and unevenness of physical properties. A cooling groove for cooling the endless belt 19 may be disposed in a portion not contacting the molding drum 18.

(Curing)

Next, FIG. 10 shows a state where the polyurethane composition is injected and sandwiched between the endless belt and the molding groove of the molding drum. While the polyurethane composition is being moved in this state, the polyurethane composition is cured by heating for a predetermined time. Thus, the urethane polymerization reaction of the polyurethane composition is completed to an extent that the polyurethane composition can be released from the molding drum 18 and the endless belt 19, and a crude product of the developing blade member for an electrophotographic apparatus having a required width, thickness, and surface properties is continuously formed. In the present embodiment using the production apparatus shown in FIG. 6, the heating temperature is preferably about 80 to 200° C. The time needed to progress the urethane polymerization reaction to an extent that the polyurethane composition can be released from the molding drum 18 and the endless belt 19 is 28 seconds to 35 seconds. However, releasing can be performed if the curing process is completed to an extent that the polyurethane composition can be released from the molding drum 18 and the endless belt 19. For this reason, the heating temperature and the heating time can be appropriately selected according to the composition of the polyurethane composition and the configuration of the production apparatus.

(Releasing and Cutting)

The polyurethane resin thus subjected to curing by heating is released from the molding drum 18 and the endless belt 19 with a releasing unit 24. It is desired that a release treatment be performed on at least a portion of the molding drum 18 contacting the polyurethane composition, such as the lateral surface 18*g* of the molding groove. Examples of the release treatment include a method of applying a mold release agent onto the surface of the mold using a mold release agent treatment apparatus or the like, and a method of plating the surface of the molding drum 18 with PTFE or fluorine-containing plating, and a method of applying a coating of a resin having releasing properties such as fluorine or silicone. Examples of the fluorine mold release agent include FLUOROSURF FG-5093SH-0.5, FLUOROSURF FG-5093TH-0.5, and FLUOROSURF FG-5093 F130-0.5 (all manufactured by Fluoro Technology Co., Ltd.). However, a suitable release treatment and a suitable mold releasing agent can be selected as long as the urethane resin can be released.

It is also desired that a release treatment be performed on at least a portion of the endless belt 19 contacting the polyurethane composition. The release treatment can be performed by the same method as that used to perform the release treatment on the molding drum 18.

Figure 11:
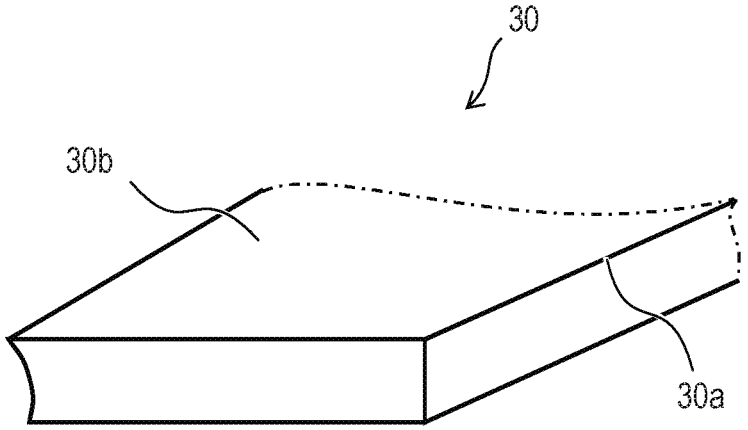
FIG. 11 is a diagram showing part of a developing blade member in the production of the developing blade.

The released band-like molded article 29 of the polyurethane resin is carried by a carrying mechanism 25, and is cut into a predetermined longitudinal size by a cutting apparatus 26 to prepare a developing blade member 30 (FIG. 11).

[Developing Blade for Electrophotographic Apparatus]

Figure 12:
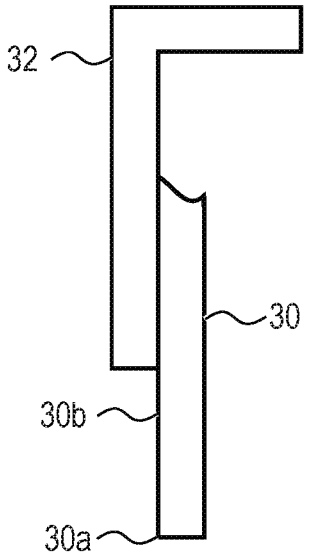
FIG. 12 is a diagram showing a developer amount regulating blade, which is produced by bonding the developing blade member to a supporting member in the production of the developing blade.

The developing blade according to the present disclosure is used as a developer amount regulating blade for an electrophotographic apparatus using electrophotographic techniques, such as copiers, laser beam printers, LED printers, and electrophotographic plate making systems. The developer amount regulating blade for an electrophotographic apparatus includes the developing blade member 30 produced by the method of producing a developing blade member described above, and a supporting member 32 engaged therewith (FIG. 12). The supporting member 32 and the developing blade member 30 can have any shapes according to the purpose of usage.

The supporting member can be made of any material such as a metal or a resin. Specifically, a metallic material such as a steel sheet, a stainless steel sheet, a zinc-plated chromate-coated steel sheet, or a chromium-free steel sheet, or a resin material such as 6-nylon or 6,6-nylon can be used. The supporting member can be joined to the developing blade member by any method, which can be appropriately selected from known methods.

<Process Cartridge and Electrophotographic Image Forming Apparatus>

The electrophotographic process cartridge according to one aspect of the present disclosure is configured to be detachably attachable to the body of an electrophotographic image forming apparatus, and includes at least a toner container containing a toner, and a developing unit which carries the toner. The developing unit includes the developing member described above.

Furthermore, the electrophotographic image forming apparatus according to one aspect of the present disclosure includes at least an electrophotographic photosensitive member, a charging unit disposed to be capable of charging the electrophotographic photosensitive member, and a developing unit that feeds a toner to the electrophotographic photosensitive member. The developing unit includes the developing member described above. Furthermore, the electrophotographic image forming apparatus according to one aspect of the present disclosure includes at least an electrophotographic photosensitive member, a charging unit disposed to be capable of charging the electrophotographic photosensitive member, and a developing unit that feeds a toner to the electrophotographic photosensitive member, and includes a bias applying unit for applying an alternate bias voltage to a developing member. The developing unit includes the developing member described above.

Figure 13:
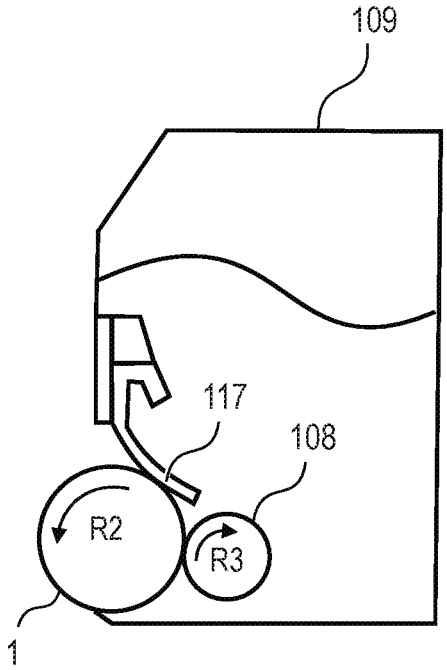
FIG. 13 is a schematic view of an electrophotographic process cartridge according to one aspect of the present disclosure.
Figure 14:
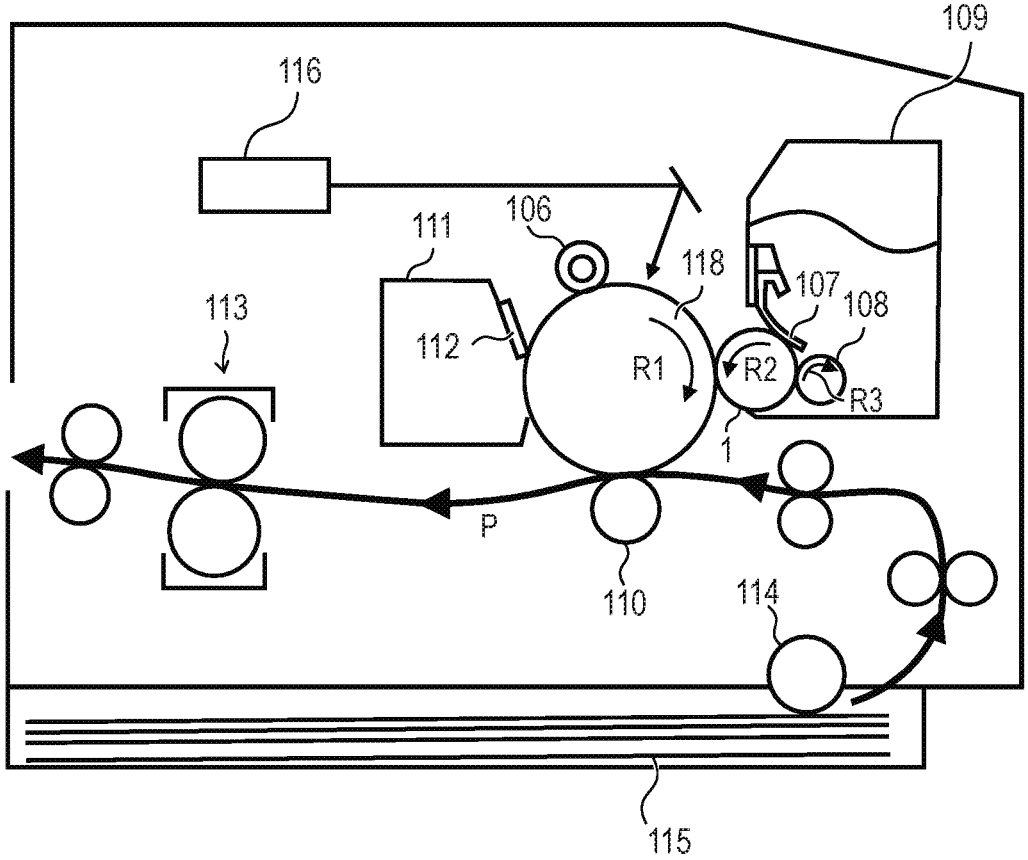
FIG. 14 is a schematic view of an electrophotographic image forming apparatus according to one aspect of the present disclosure.

The process cartridge and the electrophotographic image forming apparatus according to one aspect of the present disclosure will be described in detail with reference to the drawings. FIG. 13 is a schematic block diagram illustrating one example of a process cartridge including the developer carrier according to the present aspect as a developing member. FIG. 14 is a schematic block diagram illustrating one example of the electrophotographic image forming apparatus the process cartridge integrated to be detachably attachable thereto.

The process cartridge shown in FIG. 13 includes a toner container 109, a developer carrier 1, a developer regulating member 117, and a developer feeding member 108, and is configured to be detachably attachable to the body of the electrophotographic image forming apparatus. In FIG. 14, an electrostatic latent image bearing member 118, which is an image bearing member having an electrostatic latent image formed thereon, is rotated in the arrow direction R1. The developer carrier 1 rotates in the arrow direction R2 to carry a developer to a region to be developed where the developer carrier 1 faces the electrostatic latent image bearing member 118. The developer feeding member 108 is in contact with the developer carrier 1, and rotates in the direction R3 to feed the developer to the surface of the developer carrier 1.

A charging roller 106 as a charging member disposed to enable charging, a transfer member (transfer roller) 110, a cleaner container 111, a cleaning blade 112, a fixing unit 113, and a pickup roller 114 are disposed around the electrostatic latent image bearing member 118. The electrostatic latent image bearing member 118 is charged by the charging roller 106. The electrostatic latent image bearing member 118 is irradiated with laser light generated by a laser generating apparatus 116 to perform exposure. Thus, an electrostatic latent image corresponding to the target image is formed. The electrostatic latent image on the electrostatic latent image bearing member 118 is developed with the developer in the toner container 109 included in the process cartridge as the developing unit to form an image. Development performed is so-called reversal development where the exposed portions are developed with the developer. A transfer material (paper) P is conveyed from a paper feeder 115 into the apparatus through the pickup roller 114. The image is transferred onto the transfer material (paper) P by the transfer member (transfer roller) 110 in contact with the electrostatic latent image bearing member 118 with the transfer material (paper) P interposed. The transfer material (paper) P carrying the image is conveyed to the fixing unit 113 to fix the developer onto the transfer material (paper) P. The residual developer on the electrostatic latent image bearing member 118 is scraped by the cleaning blade 112, and is accommodated in the cleaner container 111.

It is preferred that the developer regulating member 117 be brought into contact with the developer carrier 1 with the developer interposed to regulate the thickness of the developer layer on the developer carrier. A regulating blade can be suitably used as the developer regulating member brought into contact with the developer carrier.

Usable materials for forming the regulating blade can be rubber elastic materials such as silicone rubber, urethane rubber, and NBR; synthetic resin elastic materials such as polyethylene terephthalate; and metal elastic materials such as phosphorus bronze plates and SUS plates, and may be composites thereof. Furthermore, to control the charging properties of the developer, the regulating blade may have a structure including an elastic support such as a rubber, a synthetic resin, or a metal elastic material, and a charge control material, such as a resin, a rubber, a metal oxide, or a metal, which is bonded to the elastic support. In this case, the regulating blade is used such that the portion of the charge control material is the contact region with the developer carrier. As such a regulating blade, particularly preferred are those made of metal elastic materials bonded to a resin or a rubber. As the resin or rubber, preferred are those readily positively charged such as urethane rubbers, urethane resins, polyamide resins, and nylon resins.

According to one aspect of the present disclosure, provided can be an electrophotographic developing member whose toner carrying ability barely varies according to a change in the surrounding environment.

According to another aspect of the present disclosure, provided can be an electrophotographic process cartridge and an electrophotographic image forming apparatus which can stably form high-quality electrophotographic images.

EXAMPLES

Hereinafter, the present disclosure will be specifically described by way of Production Examples and Examples, but the present disclosure will not be limited to these.

<<Developing Blade>>

[Preparation of Raw Materials]

[Prepolymer]

32.0 parts by mass of 4,4'-diphenylmethane diisocyanate (MDI) and 61.0 parts by mass of polybutylene adipate polyester polyol (PBA) having a molecular weight of 2000 were reacted under an 80° C. nitrogen atmosphere for 3 hours to prepare a prepolymer (isocyanate group content: 8.8% by mass). The MDI used is Millionate MT (manufactured by Tosoh Corporation), and the PBA is NIPPOLAN 4010 (manufactured by Tosoh Corporation).

The molecular weight of the PBA was calculated by the following expression. The hydroxyl value in the expression was calculated according to JIS-K1557-1.

$$\text{molecular weight}=(1000/\text{hydroxyl value})\times(\text{the number of functional groups})\times 56.11 \quad \text{(Expression 2)}$$

[Curing Agent]

3.9 parts by mass of 1,4-butanediol (14 BG) (manufactured by Mitsubishi Chemical Corporation), 3.2 parts by mass of trimethylolpropane (TMP) (manufactured by MITSUBISHI GAS CHEMICAL COMPANY, INC.), and a curing catalyst were mixed to prepare a curing agent.

[Curing Catalyst]

As an isocyanurating catalyst, an ethylene glycol (EG) solution of potassium acetate (Polycat 46: manufactured by Evonik Japan, K.K.) was prepared such that the compounding amount was 80 ppm in the polyurethane composition. As a urethanization catalyst, triethylenediamine (DABCO crystal: manufactured by Evonik Japan, K.K.) was prepared such that the compounding amount was 340 ppm in the polyurethane composition.

Using the raw materials above, a developing blade member was prepared with an apparatus of producing a developing blade shown in FIG. 6. The molding drum 18 was made of SK3 carbon steel, and had an outer peripheral surface subjected to a fluorine-containing plating treatment. The molding drum 18 had a molding groove having a width of 12.5 mm and a depth of 0.9 mm and continuously formed, and was driven to rotate at 0.93 rpm. The endless belt 19 was made of a metal, and the portion forming the molding cavity was subjected to a fluorine-containing plating treatment. The endless belt 19 was travelled at the same rate as the circumferential speed of the molding drum. The molding groove of the molding drum 18 had a bottom surface 18*b* surface roughened by sand blasting. The ten-point roughness average (Rz) of the bottom surface was 5.43 μm. The temperature of the endless belt was adjusted to 40° C. and that of the molding cavity was adjusted to 135° C.

The resulting prepolymer and the resulting curing agent were the tanks 10 and 11, respectively. The ejection position of the polyurethane composition was set at a position located 5 mm upstream from the start point of the molding cavity and above 5 mm from the endless belt. The curing time by heating was adjusted to 33 seconds. The molded body of the polyurethane composition prepared by curing was cut into a predetermined length by a cutting apparatus 26.

The molded surface of the resulting developing blade member having a thickness of 1 mm, which molded surface contacted the surface roughened bottom surface 18*b* of the molding groove, had a ten-point roughness average (Rz) of 5.23 μm. A distal end 30*a* of the molded product which was in contact with the distal end 18*c* of the bottom surface 18*b* of the molding groove had an arc shape having a radius of 230 μm. While the side 30*a* of the developing blade member shown in FIG. 11 was directed to the distal end direction, the surface 30*b* of the developing blade member was bonded to a supporting member using an adhesive TECHNOMELT PUR 4663 (manufactured by Henkel AG & Co. KGaA) as a humidity-curable urethane prepolymer to prepare a developing blade for an electrophotographic apparatus shown in FIG. 12.

<<Developing Member>>

<Preparation of Substrate>

[Substrate K-1]

An aluminum cylindrical tube was cut using a cutting oil (trade name: DAICUTOL V-25; manufactured by Daido Chemical Industry Co., Ltd.), and was finished by wiping with methyl ethyl ketone (MEK). The resulting hollow mandrel having an outer diameter of 14 mm was blasted using glass beads #180 (bead diameter: 90 to 100 μm) to prepare a substrate K-1 having an Ra of 1.08.

[Substrates K-2 to K-4]

The blasting condition was controlled in the same manner as that in the substrate K-1 to prepare substrates K-2 and K-3 having an Ra shown in Table 1. For the substrate K-4, a hollow substrate finished as above was used as it was.

[Substrate KK-1]

A cylindrical body made of vinyl chloride and having an outer diameter of 14 mm was prepared, and the ends thereof were processed to accommodate a process cartridge. The product was used as a substrate KK-1.

For the substrates K-1, K-2, K-3, K-4, and KK-1, their surface roughness Ra is shown in Table 1 below.

TABLE 1

| Substrate No. | Ra (μm) |
|---|---|
| K-1 | 1.08 |
| K-2 | 1.21 |
| K-3 | 1.88 |
| K-4 | 0.20 |
| KK-1 | 0.20 |

<Preparation of Coating Material for Forming Insulating Domains>

[Preparation of coating material No. Z1 for forming insulating domains]

Next, a resin for insulating domains in a compounding amount shown in Table 2 was mixed with 100 parts by mass of methyl ethyl ketone (MEK) to prepare a coating material No. Z1 for forming insulating domains.

[Preparation of Coating Materials Nos. Z2 to Z16 for Forming Insulating Domains]

Coating materials Nos. Z2 to Z16 for forming insulating domains were prepared in the same manner as that in the coating material No. Z1 for forming insulating domains except that the resin for insulating domain, the compounding amount, and the solvent were varied as shown in Table 2

TABLE 2

| Coating material No. for insulating domains | Resin for insulating domains | Parts (parts by mass) | Solvent |
|---|---|---|---|
| Z1 | Polystyrene resin (trade name: polystyreneF-4, Mw: 3.72 × 104, manufactured by Tosoh Corporation) | 10 | MEK |
| Z2 | Polystyrene resin (trade name: polystyreneA-2500, Mw: 3.12 × 103, manufactured by Tosoh Corporation) | 10 | MEK |
| Z3 | Polystyrene resin (trade name: polystyreneF-1, Mw: 9.49 × 103, manufactured by Tosoh Corporation) | 10 | MEK |
| Z4 | Polystyrene resin (trade name: polystyreneF-20, Mw: 1.89 × 105, manufactured by Tosoh Corporation) | 5 | MEK |
| Z5 | Polystyrene resin (trade name: polystyreneF-4, Mw: 3.72 × 104, manufactured by Tosoh Corporation) | 10 | Acetone |
| Z6 | Acrylic resin (trade name: HitaloidHA1473, manufactured by Hitachi Chemical Company, Ltd.) | 5 | Acetone |
| Z7 | Polystyrene resin (trade name: polystyreneF-4, Mw: 3.72 × 104, manufactured by Tosoh Corporation) | 10 | MIBK |
| Z8 | Polystyrene resin (trade name: polystyreneF-4, Mw: 3.72 × 104, manufactured by Tosoh Corporation) | 10 | DIBK |
| Z8 | Polystyrene resin (trade name: polystyreneF-4, Mw: 3.72 × 104, manufactured by Tosoh Corporation) | 10 | DIBK |
| Z9 | Polystyrene resin (trade name: polystyreneF-4, Mw: 3.72 × 104, manufactured by Tosoh Corporation) | 20 | MEK |
| Z10 | Polystyrene resin (trade name: polystyreneF-4, Mw: 3.72 × 104, manufactured by Tosoh Corporation) | 15 | MEK |
| Z11 | Polystyrene resin (trade name: polystyreneF-4, Mw: 3.72 × 104, manufactured by Tosoh Corporation) | 5 | MEK |
| Z12 | Polystyrene resin (trade name: polystyreneF-4, Mw: 3.72 × 104, manufactured by Tosoh Corporation) | 2.5 | MEK |
| Z13 | Polystyrene resin(trade name: polystyreneF-20, Mw: 1.89 × 105, manufactured by Tosoh Corporation) | 20 | Acetone |
| Z14 | Polystyrene resin (trade name: polystyreneA-500, Mw: 5.89 × 102, manufactured by Tosoh Corporation) | 10 | MEK |
| Z15 | Polystyrene resin (trade name: polystyreneF-4, Mw: 3.72 × 104, manufactured by Tosoh Corporation) | 15 | MIBK |
| Z16 | Polystyrene resin (trade name: polystyreneF-4, Mw: 3.72 × 104, manufactured by Tosoh Corporation) | 5 | MIBK |

MEK: Methyl ethyl ketone
MIBK: Methyl isobutyl ketone
DIBK: Diisobutyl ketone

<Preparation of Developing Member>

[Preparation of Developing Member 1-1] (Sample for Example: Spraying)

A coating solution containing a primer (trade name: Hamatite No. 40; manufactured by The Yokohama Rubber Co., Ltd.) and 1 part by mass of polyether-modified silicone oil (trade name: TSF4440; manufactured by Momentive Performance Materials Japan LLC) was applied to the surface of the substrate K-1, followed by baking at a temperature of 150° C. for 10 minutes to prepare a substrate K'-1.

Next, 50 to 80 μL of the coating material No. Z1 for forming insulating domains was dropped using a syringe to measure the contact angle of the droplet of the coating material No. Z1 for forming insulating domains to the surface of the substrate K'-1 after 500 ms from the dropping. The contact angle was measured using a contact angle meter DM-501 (manufactured by Kyowa Interface Science Co., Ltd.) under a measurement environment at a temperature of 23° C. and a relative humidity of 50% at atmospheric pressure and a surrounding air rate of 0.1 m/sec or less. The results are shown in Table 3.

Next, the coating material No. Z1 for forming insulating domains was applied onto the surface of the substrate K'-1 prepared by spraying according to the following procedure. First, the substrate K'-1 was vertically placed to erect, and was rotated at 500 rpm. While a spray gun was being descended at 5 mm/s, the coating material No. Z1 for forming insulating domains was applied. The coating environment was under atmospheric pressure at a temperature of 30° C. and a relative humidity of 30%. The distance between the spray gun and the surface of the substrate was 20 mm.

Furthermore, the substrate having the coating of the coating material No. Z1 for forming insulating domains was placed into an oven, and was heated at a temperature of 120° C. for 80 minutes to dry the coating of the coating material No. Z1. Thus, a developing member 1-1 having a plurality of electrically insulating domains independent from each other on the surface was prepared.

[Preparation of Developing Members 1-2 to 1-14]

The contact angle was measured in the same manner as that in the developing member 1-1 except that the substrate and the coating material for forming insulating domains were changed to the combinations shown in Table 3. The results are shown in Table 3. Developing members 1-2 to 1-14 were prepared in the same manner as that in the developing member 1-1 except that the substrate and the coating material for forming insulating domains were changed to the combinations shown in Table 3. The developing members 1-2 to 1-14 having a plurality of electrically insulating domains independent from each other on the surface were prepared in the same manner as that in the developing member 1-1.

[Developing Member 2-1]

50 to 80 μL of the coating material No. Z1 for forming insulating domains was dropped onto the surface of the substrate K-1 using a syringe to measure the contact angle of the droplet of the coating material No. Z1 for forming insulating domains to the surface of the substrate K-1 after 500 ms from the dropping. The contact angle was measured using a contact angle meter DM-501 (manufactured by Kyowa Interface Science Co., Ltd.) under a measurement environment at a temperature of 23° C. and a relative humidity of 50% at atmospheric pressure and a surrounding air rate of 0.1 m/sec or less. The results are shown in Table 3.

Next, the coating material No. Z1 for forming insulating domains was directly applied onto the surface of the substrate K-1 by spraying according to the following procedure. First, the substrate K-1 was vertically placed to erect, and was rotated at 500 rpm. While a spray gun was being descended at 5 mm/s, the coating material No. Z1 for forming insulating domains was applied. The coating environment was under atmospheric pressure at a temperature of 30° C. and a relative humidity of 30%. The distance between the spray gun and the surface of the substrate was 20 mm.

Furthermore, the substrate having the coating of the coating material No. Z1 for forming insulating domains was placed into an oven, and was heated at a temperature of 120° C. for 80 minutes to dry the coating of the coating material No. Z1. Thus, a developing member 2-1 having a plurality of electrically insulating domains independent from each other on the surface was prepared.

[Preparation of Developing Members 2-2 to 2-8]

The contact angle was measured in the same manner as that in the developing member 2-1 except that the substrate and the coating material for forming insulating domains were changed to the combinations shown in Table 3. The results are shown in Table 3. Developing members 2-2 to 2-8 were prepared in the same manner as that in the developing member 2-1 except that the substrate and the coating material for forming insulating domains were changed to the combinations shown in Table 3. The developing members 2-2 to 2-8 having a plurality of electrically insulating domains independent from each other on the surface were prepared in the same manner as that in the developing member 1-1.

[Preparation of Developing Members 1-1' and 2-1']

First, for the substrates K'-1 and K-1, the contact angle was measured using a coating material No. Z13 for forming insulating domains in the same manner as that in the developing members 1-1 and 2-1. The results are shown in Table 3.

Next, the coating material No. Z13 for forming insulating domains was applied onto the surfaces of the substrates K'-1 and K-1 by dipping according to the following procedure. First, the longitudinal direction of each substrate was aligned in the vertical direction. The upper end of the mandrel was held, and the substrate was immersed in the coating material No. Z13 for forming insulating domains, and was pulled out. The coating environment was under atmospheric pressure at a temperature of 23° C. and a relative humidity of 50%. The surrounding air rate was 0.1 m/sec or less. The immersion time was 9 seconds, and the pulling rate from the coating material No. Z13 for forming insulating domains was an initial rate of 30 mm/s and a final rate of 20 mm/s. The pulling rate from the initial rate to the final rate was linearly changed against time.

The resulting samples having a coating of the coating material No. Z13 for forming insulating domains formed on the substrate were placed into an oven, and were heated at a temperature of 120° C. for 80 minutes to dry the coating of the coating material No. Z13 for forming insulating domains. Thus, developing members 1-1' and 2-1' having a plurality of electrically insulating domains independent from each other on the surfaces were prepared.

[Preparation of Developing Member 3] (Sample for Comparative Example)

The contact angle was measured in the same manner as that in the developing member 1-1 except that the coating material for forming insulating domains was changed to the combination shown in Table 3. The results are shown in Table 3. A developing member 3 was prepared in the same manner as that in the developing member 1-1 except that the coating material for forming insulating domains was changed to the combination shown in Table 3. The developing member 3 having a plurality of electrically insulating domains independent from each other on the surface was prepared in the same manner as that in the developing member 1-1.

[Preparation of Developing Member 4] (Sample for Comparative Example)

The contact angle was measured in the same manner as that in the developing member 1-1 except that the surface of the substrate K-1 was irradiated with plasma to be hydrophilized and the coating material for forming insulating domains was changed to the combination shown in Table 3. The results are shown in Table 3. A developing member 4 was prepared in the same manner as that in the developing member 1-1 except that the surface of the substrate K-1 was irradiated with plasma to be hydrophilized and the coating material for forming insulating domains was changed to the combination shown in Table 3. The developing member 4 having a coating uniformly coated with insulating domains on the surface of the substrate K'-1 was prepared.

[Preparation of Developing Member 5] (Sample for Comparative Example)

The contact angle was measured in the same manner as that in the developing member 1-1 except that the substrate KK-1 was used. The results are shown in Table 3. A developing member 5 was prepared in the same manner as that in the developing member 1-1 except that the coating material for forming insulating domains was changed to the combination shown in Table 3. The developing member 5 having a plurality of electrically insulating domains independent from each other on the surface was prepared in the same manner as that in the developing member 1-1.

[Preparation of Developing Member 6] (Sample for Comparative Example)

The contact angle was measured in the same manner as that in the developing member 1-1 except that a coating material No. Z1 for forming insulating domains containing 0.1 parts by mass of an ionically electroconductive agent (trade name: N,N,N-trimethyl-N-propylammoniumbis(trifluoromethanesulfonyl)imide; manufactured by Tokyo Chemical Industry Co., Ltd.) was used to control the electric resistance. The results are shown in Table 3. A developing member 6 was prepared in the same manner as that in the developing member 1-1 except that the coating material for forming insulating domains was changed to the combination shown in Table 3. The developing member 6 having a plurality of electrically insulating domains independent from each other on the surface was prepared in the same manner as that in the developing member 1-1.

TABLE 3

| Developing member No. | Substrate No. | Primer | Coating material No. for insulating domain | Contact angle between the substrate surface and insulating domain coating solution |
|---|---|---|---|---|
| 1-1 | K-1 | Used | Z1 | 23 |
| 1-2 | K-1 | Used | Z2 | 15 |
| 1-3 | K-1 | Used | Z3 | 20 |
| 1-4 | K-1 | Used | Z4 | 31 |
| 1-5 | K-1 | Used | Z5 | 20 |
| 1-6 | K-2 | Used | Z6 | 11 |
| 1-7 | K-1 | Used | Z7 | 26 |
| 1-8 | K-1 | Used | Z8 | 31 |
| 1-9 | K-3 | Used | Z1 | 31 |
| 1-10 | K-4 | Used | Z1 | 23 |
| 1-11 | K-1 | Used | Z9 | 26 |
| 1-12 | K-1 | Used | Z10 | 23 |
| 1-13 | K-1 | Used | Z11 | 23 |
| 1-14 | K-1 | Used | Z12 | 23 |
| 2-1 | K-1 | Not used | Z7 | 14 |
| 2-2 | K-1 | Not used | Z3 | 12 |
| 2-3 | K-1 | Not used | Z8 | 11 |
| 2-4 | K-1 | Not used | Z8 | 22 |
| 2-5 | K-3 | Not used | Z7 | 21 |
| 2-6 | K-4 | Not used | Z7 | 14 |
| 2-7 | K-1 | Not used | Z15 | 17 |
| 2-8 | K-1 | Not used | Z16 | 14 |
| 1-1' | K-1 | Used | Z13 | 40 |
| 2-1' | K-1 | Not used | Z13 | 32 |
| 3 | K-1 | Used | Z14 | 23 |
| 4 | K-1* | Not used | Z1 | 9 |
| 5 | KK-1 | Not used | Z1 | 18 |
| 6 | K-1 | Used | ** | 23 |

*Plasma treated

**Ionically electroconductive agent added

<Evaluation of Developing Member>

<<Evaluation 1: Solidity S/H of Insulating Domain>>

The developing member 1-1 fixed to a stage such that the longitudinal direction of the developing member was aligned with the horizontal direction of the state was observed from the surface normal direction using a video microscope (trade name: DIGITAL MICROSCOPE VHX-5000, manufactured by KEYENCE CORPORATION) and a zoom lens (lens used, trade name: Swing head zoom lens VH-ZST) at a magnification of 100×. At this time, use of a ring lighting attached to the zoom lens as light for observation can darken only insulating domains in the observed image of the surface of the developing member.

In the center of the resulting image, a rectangular area of the developing member 1-1 measuring 3 mm in the longitudinal direction and 1 mm in the circumferential direction was defined as an observation area. Using image analysis software Image J ver. 1.45 (developed by Wayne Rasband National Institutes of Health, NIH), a background luminance distribution was removed with a Subtract Background menu at a smoothing radius of 40 pixels, and the insulating domains were binarized at a luminance threshold of 128. Only the insulating domains fully contained in the observation area were targets for observation.

In the resulting binarized image, the solidity S/H was measured with the Analyze Particle menu of the Image J. The Solidity output by Image J corresponds to the solidity S/H.

The developing member was observed and measured at any 50 points, and the number proportion where the S/H of the insulating domain was 0.05 or more and 0.80 or less and the arithmetic average of the values of S/H were determined.

<<Evaluation 2: Charging Properties of Outer Surface of Developing Member>>

The presence of the insulating domain-coated portions and the non-insulating domain-coated portion on the outer surface of the developing member 1-1 was verified by observing the outer surface of the developing member 1-1 with an optical microscope or a scanning electron microscope.

(Observation of Outer Surface of Developing Member)

One example of observation of the outer surface of the developing member according to the present disclosure will now be described.

First, the outer surface of the developing member was observed with an optical microscope (VHX 5000 (product name), manufactured by KEYENCE CORPORATION) to verify the presence of two or more regions of electroconductive portion and insulating portion on the outer surface thereof. In the next step, a thin piece including the outer surface of the developing member was cut out from the developing member together with the substrate using a cryomicrotome (UC-6 (product name), manufactured by Leica Microsystems GmbH). The thin piece was cut at a temperature of −150° C. such that the dimension of the outer surface of the developing member was 100 μm×100 μm, the thickness in terms of the outer surface of the substrate was 1 μm, and two or more regions on the outer surface of the developing member were contained. In the next step, the outer surface of the developing member on the cut thin piece was observed using an optical microscope.

(Measurement of Residual Potential Distribution)

The residual potential distribution was obtained as follows: the outer surface of the developing member on the thin piece was corona charged by a corona discharge apparatus, and the residual potential of the outer surface was measured with an electrostatic force microscope (MODEL 1100TN, manufactured by Trek Japan K.K.) while the thin piece was being scanned.

First, the thin piece was placed on a smooth silicon wafer such that a surface containing the outer surface of the developing roller was the top surface, and was left to stand under an environment at a temperature of 23° C. and a relative humidity of 50% for 24 hours. In the next step, the silicon wafer with the thin piece disposed thereon was placed on a high-precision XY stage including a built-in electrostatic force microscope under the same environment as above. In the corona discharge apparatus used, the distance between the wire and the grid electrode was 8 mm. The corona discharge apparatus was arranged at a position such that the distance between the grid electrode and the surface of the silicon wafer was 2 mm. In the next step, the silicon wafer was grounded, a voltage of −5 kV was applied to the wire and a voltage of −0.5 kV was applied to the grid electrode using an external power supply. After the application was started, using the high-precision XY stage, the thin piece was scanned parallel to the surface of the silicon wafer at a rate of 20 mm/s such that the thin piece passed through immediately under corona discharge apparatus. Thus, the outer surface of the developing member on the thin piece was corona charged.

Subsequently, using the high-precision XY stage, the thin piece was moved to a position immediately under the cantilever of the electrostatic force microscope. In the next step, while scanning was being performed using the high-precision XY stage, the residual potential of the corona charged outer surface of the developing member was measured to determine the residual potential distribution. The conditions for measurement are shown below.

- environment for measurement: temperature of 23° C., relative humidity of 50%
- time until the target portion passes through immediately under the corona discharge apparatus and measurement is started: 1 min
- cantilever: cantilever for Model 1100TN (type No.; Model 1100TNC-N, manufactured by Trek Japan K.K.)
- gap between the measured surface and the distal end of the cantilever: 10
- measurement range: 99 μm×99 μm
- measurement interval: 3 μm×3 μm By confirming the presence of the residual potential in two or more regions present on the thin piece from the residual potential distribution obtained from the measurement, it was verified whether the regions were the insulating domain-coated portions or the non-insulating domain-coated portion having a conductivity higher than that of the insulating domain-coated portion. Specifically, among the two or more regions, a region including a portion having an absolute value of the residual potential of less than 1 V was determined as the non-insulating domain-coated portion, and a region having an absolute value of the residual potential more than 1 V higher than the absolute value of the residual potential of the electroconductive portion was determined as the insulating domain-coated portion.

(Measurement of Time Constant of Residual Potential)

The outer surface of the developing member was corona charged by the corona discharge apparatus, and the time transition of the residual potential on the electrically insulating domains or the electrically electroconductive layer present on the outer surface was measured with an electrostatic force microscope (MODEL 1100 TN, manufactured by Trek Japan K.K.), followed by fitting with the expression (1) for calculation to determine the time constant. Here, the measurement point for the insulating domain-coated portions was a point having the largest absolute value of the residual potential among the insulating domain-coated portions verified in the measurement of the residual potential distribution. The measurement point for the non-insulating domain-coated portion was a point having a residual potential of approximately 0 V among the non-insulating domain-coated portions verified in the measurement of the residual potential.

First, the thin piece used in the measurement of the residual potential distribution was placed on a smooth silicon wafer such that the surface including the outer surface of the developing member was the top surface, and was left to stand under an environment at room temperature (23° C.) and a relative humidity of 50% for 24 hours. Subsequently, under the same environment as above, the silicon wafer with the thin piece disposed thereon was placed on a high-precision XY stage including a built-in electrostatic force microscope. In the corona discharge apparatus used, the distance between the wire and the grid electrode was 8 mm. The corona discharge apparatus was arranged at a position such that the distance between the grid electrode and the surface of the silicon wafer was 2 mm. In the next step, the silicon wafer was grounded, and a voltage of −5 kV was applied to the wire and a voltage of −0.5 kV was applied to the grid electrode using an external power supply. After the application was started, using the high-precision XY stage, the thin piece was scanned parallel to the surface of the silicon wafer at a rate of 20 mm/s such that the thin piece passed through immediately under corona discharge apparatus. Thus, the thin piece was corona charged.

Subsequently, using the high-precision XY stage, the measurement point of the electric insulating portion or the electrically electroconductive layer was moved to a position immediately under the cantilever of the electrostatic force microscope to measure the time transition of the residual potential. The measurement was performed using an electrostatic force microscope. The conditions for measurement are shown below.

- environment for measurement: temperature of 23° C., relative humidity of 50%
- time until the measurement portion passes through immediately under the corona discharge apparatus and measurement is started: 15 sec
- cantilever: cantilever for Model 1100TN (type No.; Model 1100TNC-N, manufactured by Trek Japan K.K.)
- gap between the measured surface and the distal end of the cantilever: 10 μm
- measurement frequency: 6.25 Hz
- measurement time: 1000 sec The time constant τ was determined by fitting the time transition of the residual potential obtained from the measurement into the expression (1) for calculation by the method of least squares:

$$V_0 = V(t) \times \exp(-t/\tau) \qquad \text{expression (1) for calculation}$$

In the expression (1) for calculation, t, $V_0$, V(t), and τ are defined as follows: t: lapse time (seconds) since the measurement point has passed through immediately under the corona discharge apparatus;

$V_0$: initial potential (potential at t=0 seconds) (V);

V(t): residual potential (V) after t seconds since the measurement point has passed through immediately under the corona discharge apparatus;

τ: time constant (seconds) of the residual potential.

At 9 points in total (3 points in the longitudinal direction×3 points in the circumferential direction 3 points) in the outer surface of the developing member, the time constant τ of the residual potential was measured, and the average was determined as the time constant of the residual potential of the electric insulating portion or the electrically electroconductive layer. It was verified that the average was 60.0 seconds or more and 6.0 seconds or less.

<<Evaluation 3: Area S of Insulating Domain>>

The area S of the insulating domain was determined. Only the insulating domains which were targets in the measurement of the S/H were targeted. The number proportion where the area S of insulating domain was 300 $\mu m^2$ or more and 100000 $\mu m^2$ or less and the arithmetic average of the area S were determined.

<<Evaluation 4: Horizontal Feret's Diameter of Insulating Domain>>

The horizontal Feret's diameter of the insulating domain was determined. Only the insulating domains which were targets in the measurement of the S/H were targeted. A rectangle circumscribing the insulating domain was drawn such that one side thereof was parallel to the longitudinal direction of the developing member, and the length of the side was defined as a horizontal Feret's diameter R'. The arithmetic average of the horizontal Feret's diameter was determined.

<<Evaluation 5: Coverage of Insulating Domain>>

The coverage of the insulating domain was determined. Using 50 images for observation obtained in the measurement of the S/H, the sum of the areas of the insulating domains present in an area of the observation field was defined as S', and the proportion of the sum S' in the observation field was defined as a coverage A' of the insulating domain. The same measurement was performed on the 50 images for observation, and the arithmetic average of the obtained values was defined as a coverage A.

<<Evaluation 6: Thickness of Insulating Domain>>

The thickness of the insulating domain was determined. A cross-section of the developing member 1 was cut out with a razor blade vertical to the surface of the developing member 1. This cross-section was observed with a scan electron microscope (trade name: JSM-7800 FPRIME Schottky emission scanning electron microscope, manufactured by JEOL, Ltd.). The maximum value of the thickness of the insulating domain in the normal direction of the surface of the developing member was defined as L'. This measurement was performed on any 20 points of the surface of the developing member, and the arithmetic average of the obtained values was defined as the thickness L of the insulating domain.

[Measurement of Developing Members 1 to 6]

The solidity S/H of the insulating domain, the area S, the horizontal Feret's diameter, the coverage, and the thickness were determined by the evaluation methods above. The results are shown in Table 4.

For the developing members 3 and 4, the number proportion of domains having a value of S/H in the range of 0.05 to 0.80 was 0%.

For the developing member 4, independent insulating domains were not present, and a uniform film was formed. For this reason, the number proportion of domains having a value of S/H in the range of 0.05 to 0.80 was 0%.

TABLE 4

| | Evaluation 1 | | Evaluation 2 | | Evaluation 3 | |
|---|---|---|---|---|---|---|
| Developing member No. | Number proportion where 0.05 ≤ S/H ≤ 0.80 | Average of S/H | Time constant (seconds) of insulating domain-coated portion | Time constant (seconds) of non-insulating domain-coated portion | Number proportion where area S is 300 $\mu m^2$ or more and 100000 $\mu m^2$ or less | Average of area S ($\mu m^2$) |
| 1-1 | 64 | 0.41 | 77.2 | 1.1 | 81 | 11877 |
| 1-2 | 21 | 0.61 | 82.9 | 1.1 | 80 | 4913 |
| 1-3 | 33 | 0.48 | 80.3 | 1.1 | 82 | 8199 |
| 1-4 | 60 | 0.15 | 80.3 | 1.1 | 80 | 8303 |
| 1-5 | 61 | 0.4 | 78.0 | 1.1 | 65 | 3271 |
| 1-6 | 57 | 0.44 | 76.6 | 1.2 | 30 | 1793 |
| 1-7 | 58 | 0.31 | 95.2 | 1.1 | 59 | 32448 |
| 1-8 | 60 | 0.28 | 107.4 | 1.1 | 31 | 64046 |
| 1-9 | 59 | 0.4 | 92.6 | 1.6 | 82 | 3235 |
| 1-10 | 63 | 0.38 | 108.6 | 1.0 | 89 | 51271 |
| 1-11 | 61 | 0.38 | 118.9 | 1.1 | 80 | 18290 |
| 1-12 | 62 | 0.38 | 110.4 | 1.1 | 81 | 17825 |
| 1-13 | 62 | 0.4 | 73.3 | 1.1 | 86 | 7885 |
| 1-14 | 63 | 0.41 | 67.3 | 1.1 | 87 | 7034 |
| 1-1' | 30 | 0.042 | 79.8 | 1.1 | 81 | 18501 |
| 2-1 | 41 | 0.59 | 73.8 | — | 80 | 14802 |
| 2-2 | 22 | 0.64 | 78.4 | — | 80 | 6802 |
| 2-3 | 38 | 0.46 | 74.4 | — | 62 | 6033 |
| 2-4 | 37 | 0.34 | 84.2 | — | 30 | 86035 |
| 2-5 | 39 | 0.39 | 81.1 | — | 86 | 5279 |
| 2-6 | 45 | 0.39 | 98.6 | — | 88 | 60279 |
| 2-7 | 39 | 0.55 | 100.1 | — | 80 | 19129 |
| 2-8 | 40 | 0.4 | 67.1 | — | 86 | 9121 |
| 2-1' | 26 | 0.033 | 74.7 | — | 80 | 21546 |
| 3 | 0 | 0.9 | 117.7 | 1.1 | 90 | 2318 |
| 4 | 0 | — | 101.5 | — | 0 | — |
| 5 | 31 | 0.89 | 174.4 | 184.1 | 42 | 10338 |
| 6 | 62 | 0.39 | 53.3 | 1.1 | 78 | 5612 |

| Developing member No. | Evaluation 4 Horizontal Feret's diameter (μm) | Evaluation 5 Coverage (%) | Evaluation 6 Thickness (μm) |
|---|---|---|---|
| 1-1 | 334 | 23 | 0.9 |
| 1-2 | 211 | 25 | 1.1 |
| 1-3 | 299 | 24 | 1.2 |
| 1-4 | 386 | 27 | 1.9 |
| 1-5 | 99 | 20 | 0.7 |
| 1-6 | 101 | 24 | 0.8 |
| 1-7 | 825 | 24 | 2.5 |
| 1-8 | 730 | 27 | 2.2 |
| 1-9 | 61 | 30 | 1.4 |

TABLE 4-continued

| | | | |
|---|---|---|---|
| 1-10 | 2532 | 25 | 0.9 |
| 1-11 | 296 | 56 | 5.1 |
| 1-12 | 442 | 45 | 4.2 |
| 1-13 | 401 | 14 | 0.8 |
| 1-14 | 289 | 11 | 0.5 |
| 1-1' | 462 | 17 | 2.5 |
| 2-1 | 599 | 28 | 0.9 |
| 2-2 | 449 | 30 | 0.9 |
| 2-3 | 320 | 26 | 0.9 |
| 2-4 | 922 | 36 | 1.1 |
| 2-5 | 87 | 34 | 1.3 |
| 2-6 | 3531 | 21 | 0.7 |
| 2-7 | 542 | 48 | 4.0 |
| 2-8 | 712 | 18 | 0.6 |
| 2-1' | 654 | 14 | 2.1 |
| 3 | 50 | 30 | 1.8 |
| 4 | — | 100 | 0.9 |
| 5 | 1425 | 31 | 1.1 |
| 6 | 460 | 31 | 0.9 |

<<Evaluation 7: Evaluation of Insulating Domain>>

[Insulating Domains Having Different Values of S/H]

For the domains having a value of S/H within the range of 0.05 to 0.80 and having a value out of the range, the charge retention and the toner deposit amount under an environment at a high temperature and a high humidity were evaluated.

First, eight domains having different values of the solidity S/H were selected from developing members 1-1, 1-2, 1-4, and 3, respectively. The domains were defined as domains Nos. 1 to 8. The solidity S/H, the area, and the horizontal Feret's diameter of each domain are shown in Table 5.

[Evaluation of Insulating Domain No. 1]

[Evaluation 7-1: Evaluation of Charge of Insulating Domain]

The developing member 1-1 was integrated in an electrophotographic image forming apparatus (trade name, HP LaserJet Enterprise M609dn, manufactured by Hewlett-Packard Company) and a process cartridge 37Y (manufactured by Hewlett-Packard Company) from which a toner feed roller was removed, and was left to stand under an environment at a temperature of 30° C. and a humidity of 80% RH for 24 hours. Next, under the same environment, a solid black image was continuously output onto 20 sheets at a rate of 30 sheets of size A4/min, and the domain No. 1 on the developing member 1-1 was charged.

Next, the toner was removed by air blowing, and the developing member 1-1 was set in Electrostatic Force Microscope (manufactured by Trek Japan K.K.) disposed under the same environment to measure the surface potential of the domain No. 1 on the surface of the developing member 1-1. The condition was set such that the distance between the probe distal end of the cantilever and the surface of the domain was 10 μm, and the measurement was performed in a region of a 1 mm square at a pitch of 2 μm. The arithmetic average of the resulting surface potentials on the insulating domains was defined as the surface potential of the domain No. 1. This measurement was started after 5 minutes from the completion of charge previously performed. The results are shown in Table 5.

[Evaluation 7-2: Evaluation of Toner Deposit Amount of Insulating Domain]

A toner was removed from the process cartridge 37Y (manufactured by Hewlett-Packard Company) for an electrophotographic image forming apparatus (trade name, HP LaserJet Enterprise M609dn, manufactured by Hewlett-Packard Company), and 800 ml of the toner was filled into a 1000 mL polypropylene measuring cylinder (overall height: 285 mm, inner diameter: ϕ70 mm). The developing member 1 was put into and pulled out from the measuring cylinder to deposit the toner on the domain No. 1.

Next, the amount of the toner deposited near the insulating domain was measured. The amount of the toner was measured with a laser microscope (trade name: VK-8700, manufactured by KEYENCE CORPORATION) using a 50× object lens. The domain No. 1 was measured from immediately above the domain with a laser microscope to obtain the height information. The height information was obtained at a measurement pitch of 283 nm. Subsequently, the toner was blown off with compressed air to obtain the height information of the same region. From the difference between these two pieces of height information, the height information of the toner deposited on the domain No. 1 can be obtained. In the examination in the present disclosure, the arithmetic average of values of the height information of the toner deposited on the domains was defined as the amount of the toner on the domain No. 1. The average of toner heights is shown in Table 5.

[Evaluation of Domains Nos. 2 to 8]

Domains Nos. 2 to 8 were evaluated in the same manner as that in the domain No. 1. The results are shown in Table 5.

TABLE 5

| Domain No. | Solidity S/H | Area ($\mu m^2$) | Horizontal Feret's diameter (μm) | Evaluation 7-1 Potential (V) | Evaluation 7-2 Toner height (μm) |
|---|---|---|---|---|---|
| 1 | 0.37 | 11,837 | 256 | −14.1 | 23.7 |
| 2 | 0.52 | 11,709 | 250 | −14.1 | 26.2 |
| 3 | 0.63 | 13,451 | 264 | −10.9 | 21.1 |
| 4 | 0.03 | 7,403 | 468 | −3.8 | 2.2 |
| 5 | 0.05 | 10,731 | 454 | −11.2 | 14.8 |
| 6 | 0.23 | 8,662 | 346 | −13.1 | 21.5 |
| 7 | 0.80 | 6,902 | 251 | −11.9 | 17.8 |
| 8 | 0.93 | 3,658 | 72 | −4.3 | 4.5 |

The results in evaluations 7-1 and 7-2 show that if the S/H of the domain is 0.05 or more and 0.80 or less, the toner deposit amount in the regions including the convex envelope of the insulating domain is significantly increased.

<Evaluation 8: Evaluation of Image>

[Evaluation 8-1: Evaluation of Charge of Developing Member at 30° C./80% RH]

First, to reduce the torque, a toner feed roller was removed from the process cartridge 37Y (manufactured by Hewlett-Packard Company) for an electrophotographic image forming apparatus (trade name, HP LaserJet Enterprise M609dn, manufactured by Hewlett-Packard Company). As a result, the torque is reduced while the amount of the toner fed to the developing member is reduced. Next, the developing member 1-1 was mounted as a developing member of the process cartridge, and was left to stand under an environment at a temperature of 30° C. and a humidity of 80% RH for 24 hours. Next, under the same environment, a solid black image was continuously output onto 20 sheets at a rate of 30 sheets of size A4/min, and the developing member 1-1 was removed. The toner was blown off with air, and the surface potential of the developing member 1-1 was measured. At this time, the measured region was a region between the electrophotographic photosensitive member and the developer amount regulating member when the output operation was stopped. In the measurement method, the mandrel of the developing member 1-1 was grounded, a surface potential probe (trade name: MODEL 6000B-8) was connected to a surface electrometer (trade name: MODEL344, manufactured by Trek Inc.), and measurement was performed at a position 6 mm away from the surface of the developing member to determine the surface potential of the developing member 1-1.

[Evaluation 8-2: Evaluation of Amount of Toner Carried by Developing Member at 30° C./80% RH]

Next, under the same environment, after a solid black image was continuously output onto 10 sheets at a rate of 30 sheets of size A4/min, the output operation was stopped while the solid black image was being output onto one sheet. The developing member 1-1 was removed, and the amount of the toner adhering onto the developing member 1-1 (amount of the toner carried) was measured. At this time, the measured region was a region between the electrophotographic photosensitive member contact region and the toner regulating member contact region when the output operation was stopped. In the measurement method, the toner was sucked using a sucking nozzle having an opening having a diameter of 5 mm, and the mass of the sucked toner and the area of the sucked region were measured to determine the amount ($mg/cm^2$) of the toner carried. The results were evaluated according to the following criteria:

Rank A: 1.20 $mg/cm^2$ or more.

Rank B: 0.80 $mg/cm^2$ or more and less than 1.20 $mg/cm^2$.

Rank C: 0.40 $mg/cm^2$ or more and less than 0.80 $mg/cm^2$.

Rank D: less than 0.40 $mg/cm^2$.

[Evaluation 8-3: Evaluation of Difference in Image Density of Developing Member at 30° C./80% RH]

Next, a solid black image was output onto a sheet at a rate of 30 sheets of size A4/min, and the image density of the resulting solid black image was measured with a spectrodensitometer (trade name: 508, manufactured by X-Rite Inc.). The difference in density of the image between the distal end and the postal end was determined, and was evaluated according to the following criteria:

Rank A: less than 0.05.

Rank B: 0.05 or more and less than 0.10.

Rank C: 0.10 or more and less than 0.20.

Rank D: 0.20 or more.

[Evaluation 8-4: Evaluation of Charge of Developing Member at 15° C./10% RH]

The electrophotographic image forming apparatus and the process cartridge without the toner feed roller, which were used in the evaluations above, were left to stand under an environment at a temperature of 15° C. and a humidity of 10% RH for 24 hours. Next, under the same environment, after a solid white image was continuously output onto 50 sheets at a rate of 30 sheets of size A4/min, the output operation was stopped while the solid white image was being output onto a sheet. The developing member 1-1 was removed, and the toner was blown off with air. The surface potential of the developing member 1-1 was measured. At this time, the measured region was a region between the electrophotographic photosensitive member and the developer amount regulating member when the output operation was stopped. In the measurement method, the mandrel of the developing member 1-1 was grounded, a surface potential probe (trade name: MODEL 6000B-8) was connected to a surface electrometer (trade name: MODEL344, manufactured by Trek Inc.), and measurement was performed at a position 6 mm away from the surface of the developing member to determine the surface potential of the developing member 1-1. The results were evaluated according to the following criteria:

Rank A: less than −15 V

Rank B: −15 V or more and less than −25 V.

Rank C: −25 V or more and less than −35 V.

Rank D: −35 V or more.

[Evaluation 8-5: Evaluation of Stability of Image Density in Developing Member at 15° C./10% RH]

Next, at a rate of 30 sheets of size A4/min, a 25% halftone image for a solid black image was continuously output onto a sheet, a solid white image onto 48 sheets, and the 25% halftone image for a solid black image onto a sheet. The density of the first halftone image and that of the 50th halftone image were measured with a spectrodensitometer (trade name: 508, manufactured by X-Rite Inc.) to determine the difference in density between the first and 50th images. The difference in image density was evaluated according to the following criteria:

Rank A: less than 0.05.

Rank B: 0.05 or more and less than 0.10.

Rank C: 0.10 or more and less than 0.20.

Rank D: 0.20 or more.

The developing members according to other Examples and Comparative Examples were fed to Evaluations 8-1 to 8-5. The results are shown in Table 6.

TABLE 6

| | Developing member No. | Evaluation 8-1 H/H surface potential (V) | Evaluation 8-2 H/H amount of toner carried ($mg/cm^2$) | Evaluation 8-2 Evaluation of H/H amount of toner carried | Evaluation 8-3 Evaluation of H/H image | Evaluation 8-4 Evaluation of H/H image | Evaluation 8-4 Evaluation of L/L surface potential | Evaluation 8-5 Evaluation of L/L image |
|---|---|---|---|---|---|---|---|---|
| Example 1 | 1-1 | −6.6 | 1.42 | A | A | −8.9 | A | A |
| Example 2 | 1-2 | −4.0 | 1.01 | B | B | −10.8 | A | A |
| Example 3 | 1-3 | −5.2 | 1.26 | A | B | −9.9 | B | A |
| Example 4 | 1-4 | −5.9 | 1.32 | A | B | −9.9 | A | A |
| Example 5 | 1-5 | −5.4 | 1.28 | A | B | −9.2 | A | A |
| Example 6 | 1-6 | −3.6 | 0.96 | B | B | −8.7 | A | A |
| Example 7 | 1-7 | −6.4 | 1.31 | A | B | −14.8 | A | A |
| Example 8 | 1-8 | −5.4 | 1.14 | B | B | −18.8 | B | B |
| Example 9 | 1-9 | −3.4 | 0.91 | B | B | −14.0 | A | A |
| Example 10 | 1-10 | −6.5 | 1.33 | A | B | −19.2 | B | B |
| Example 11 | 1-11 | −7.4 | 1.60 | A | A | −22.6 | B | B |
| Example 12 | 1-12 | −6.8 | 1.52 | A | A | −19.8 | B | B |
| Example 13 | 1-13 | −3.3 | 0.74 | C | B | −7.7 | A | A |
| Example 14 | 1-14 | −3.1 | 0.63 | C | B | −5.7 | A | A |
| Example 15 | 1-1' | −3.3 | 1.02 | B | B | −9.8 | A | A |
| Example 16 | 2-1 | −3.9 | 0.71 | C | B | −7.8 | A | A |
| Example 17 | 2-2 | −2.9 | 0.61 | C | B | −5.8 | A | A |
| Example 18 | 2-3 | −5.2 | 0.64 | C | B | −5.9 | A | A |
| Example 19 | 2-4 | −6.5 | 0.84 | B | B | −10.2 | A | A |
| Example 20 | 2-5 | −5.9 | 1.13 | B | B | −9.7 | A | A |
| Example 21 | 2-6 | −6.9 | 1.28 | A | B | −14.2 | A | A |
| Example 22 | 2-7 | −6.7 | 1.02 | B | B | −19.5 | A | A |
| Example 23 | 2-8 | −3.1 | 0.65 | C | B | −5.6 | A | A |
| Example 24 | 2-1' | −2.80 | 0.71 | C | B | −8.1 | A | A |
| Comparative Example 1 | 3 | −1.89 | 0.33 | D | D | −32.1 | C | C |
| Comparative Example 2 | 4 | −3.15 | 0.16 | D | D | −35.6 | C | C |
| Comparative Example 3 | 5 | −47.3 | 0.18 | D | D | −171.7 | D | D |
| Comparative Example 4 | 6 | −0.5 | 0.135 | D | D | −1.1 | A | D |

In Examples 1 to 24, it was verified that a plurality of insulating domains independent from each other were present on the outer surface of the developing member. At the same time, domains having a value of S/H within the range of $0.05 \leq S/H \leq 0.80$ according to the present disclosure were verified, where in an orthographic representation of each of the insulating domains onto the surface of the electrically electroconductive layer, the area of the orthographically projected image of each domain was defined as S and the area of the convex envelope in the orthographically projected image of the domain was defined as H.

From the results of Examples 1 to 24 and Comparative Examples 1 to 4 and the values of S/H of the insulating domains within such a range specified in the present disclosure, it was found that a high toner carrying ability can be provided both under an environment at a low temperature and a low humidity and under an environment at a high temperature and a high humidity, and high-quality electrophotographic images can be formed without the developing member excessively charged.

Examples 1 to 4, 15, 16, 17, and 24 show that by controlling the number proportion of the value of S/H of the insulating domain to the range specified by the present disclosure, a high toner carrying ability can be provided both under an environment at a low temperature and a low humidity and under an environment at a high temperature and a high humidity, and high-quality electrophotographic images can be formed more favorably without the developing member excessively charged.

Examples 1, 5 to 8, 16, 18, and 19 show that by controlling the area S of the insulating domain to the range specified by the present disclosure, a high toner carrying ability can be provided both under an environment at a low temperature and a low humidity and under an environment at a high temperature and a high humidity, and high-quality electrophotographic images can be formed more favorably without the developing member excessively charged.

Examples 1, 9, 10, 16, 20, and 21 show that by controlling the arithmetic average of the horizontal Feret's diameters of the insulating domains to the range specified by the present disclosure, a high toner carrying ability can be provided both under an environment at a low temperature and a low humidity and under an environment at a high temperature and a high humidity, and high-quality electrophotographic images can be formed more favorably without the developing member excessively charged.

Examples 1, 11 to 14, 16, 22, and 23 show that if the sum of the areas S of insulating domains present in a rectangular region of 3.0 mm in the longitudinal direction and 1.0 mm in the circumferential direction on the outer surface of the developing member is controlled to the proportion in the area of the region specified by the present disclosure, a high toner carrying ability can be provided both under an environment at a low temperature and a low humidity and under an environment at a high temperature and a high humidity, and high-quality electrophotographic images can be formed more favorably without the developing member excessively charged.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-154096, filed Aug. 26, 2019, which is hereby incorporated by reference herein in its entirety.

What is claimed is:

1. An electrophotographic developing member, comprising:

a substrate having an electroconductive outer surface;

an electrically insulating resin layer on the electroconductive outer surface of the substrate; and electrically insulating domains on an outer surface of the electrically insulating resin layer;

the electrophotographic developing member having an outer surface including a surface of the electrically insulating resin layer and surfaces of the electrically insulating domains, wherein when the surfaces of the domains constituting the outer surface of the developing member are electrically charged so as to have potential of $V_0$ (V), a potential decay time constant defined as a period of time necessary for a potential of each of the surfaces of the domains to decay to $V_0 \times (1/e)$ (V) is 60.0 seconds or longer, and when the surface of the electrically insulating resin layer constituting the outer surface of the developing member is electrically charged so as to have a potential of $V_0$ (V), a potential decay time constant defined as a period of time necessary for a potential of the surface of the electrically insulating resin layer to decay to $V_0 \times 1/e)$ (V), is shorter than 6.0 seconds, and assuming that the electrically insulating domains are orthographically projected onto the electroconductive outer surface of the substrate to obtain projection images of the respective electrically insulating domains, at least one of the domains satisfies $0.05 \leq S/H \leq 0.80$ where each of areas of the projection images is defined as S, and each of areas of convex envelopes of the projection images is defined as H.

2. An electrophotographic developing member comprising:

a substrate having an outer surface containing a metal; and electrically insulating domains directly disposed on the outer surface of the substrate;

the electrophotographic developing member having an outer surface including the outer surface of the substrate, and surfaces of the electrically insulating domains, wherein when the surfaces of the domains constituting the outer surface of the developing member are electrically charged so as to have potential of $V_0$ (V), a potential decay time constant defined as a period of time necessary for a potential of each of the surfaces of the domains to decay to $V_0 \times (1/e)$ (V) is 60.0 seconds or longer, and assuming that the electrically insulating domains are orthographically projected onto the electroconductive outer surface of the substrate to obtain projection images of the respective electrically insulating domains, at least one of the domains satisfies $0.05 \leq S/H \leq 0.80$ wherein each of areas of the projection images is defined as S, and each of areas of convex envelopes of the projection images is defined as H.

3. The developing member according to claim 1, wherein at least 20% by number of the domains satisfy $0.05 \leq S/H \leq 0.80$.

4. The developing member according to claim 3, wherein at least 80% by number of the domains have an area S in the range of 300 to 100000 $\mu m^2$.

5. The developing member according to claim 3, wherein the domains have a horizontal Feret's diameter of 100 to 2000 μm.

6. The developing member according to claim 3, wherein the sum of the areas S of the domains present in a rectangular region of 3.0 mm of the side in the longitudinal direction and 1.0 mm of the side in the circumferential direction on the outer surface of the developing member is 15 to 50% of the area of the rectangular region.

7. An electrophotographic process cartridge configured to be detachably attachable to a body of an electrophotographic image forming apparatus, an electrophotographic process cartridge comprising a toner container containing a toner, and a developing unit configured to carry the toner, wherein the developing unit including a developing member comprising:

a substrate having an electroconductive outer surface;

an insulating layer on the electroconductive outer surface of the substrate; and electrically insulating domains on an outer surface of insulating layer;

the electrophotographic developing member having an outer surface including a surface of the insulating resin layer and surfaces of the electrically insulating domains, wherein when the surfaces of the domains constituting the outer surface of the developing member are electrically charged so as to have potential of $V_0$ (V), a potential decay time constant defined as a period of time necessary for a potential of each of the surfaces of the domains to decay to $V0 \times (1/e)$ (V) is 60.0 seconds or longer, when the surface of the electrically insulating layer constituting the outer surface of the developing member is electrically charged so as to have a potential of $V_0$ (V), a potential decay time constant defined as a period of time necessary for a potential of the surface of the electrically insulating layer to decay to $V_0 \times (1/e)$ (V), is shorter than 6.0 seconds, and assuming that the electrically insulating domains are orthographically projected onto the electroconductive outer surface of the substrate to obtain projection images of the respective electrically insulating domains, at least one of the domains satisfies $0.05 \leq S/H \leq 0.80$ where each of areas of the projection images is defined as S, and each of areas of convex envelopes of the projection images is defined as H.

8. An electrophotographic image forming apparatus, comprising a charging unit disposed to be capable of charging an electrophotographic photosensitive member, and a developing unit configured to feed a toner to the electrophotographic photosensitive member, the developing unit including a developing member, comprising:

a substrate having an electroconductive outer surface;

an insulating layer on the electroconductive outer surface of the substrate; and electrically insulating domains on an outer surface of insulating layer;

the electrophotographic developing member having an outer surface including a surface of the insulating resin layer and surfaces of the electrically insulating domains, wherein when the surfaces of the domains constituting the outer surface of the developing member are electrically charged so as to have potential of $V_0$ (V), a potential decay time constant defined as a period of time necessary for a potential of each of the surfaces of the domains to decay to V0×(1/e) (V) is 60.0 seconds or longer, when the surface of the electrically insulating layer constituting the outer surface of the developing member is electrically charged so as to have a potential of $V_0$ (V), a potential decay time constant defined as a period of time necessary for a potential of the surface of the electrically insulating layer to decay to $V_0$×(1/e) (V), is shorter than 6.0 seconds, and assuming that the electrically insulating domains are orthographically projected onto the electroconductive outer surface of the substrate to obtain projection images of the respective electrically insulating domains, at least one of the domains satisfies 0.05≤S/H≤0.80 where each of areas of the projection images is defined as S, and each of areas of convex envelopes of the projection images is defined as H.

9. The electrophotographic image forming apparatus according to claim 8, further comprising a bias applying unit configured to apply an alternate bias voltage to the developing member.

10. The developing member according to claim 2, wherein at least 20% by number of the domains satisfy 0.05≤S/H≤0.80.

11. The developing member according to claim 10, wherein at least 80% by number or more of the domains have an area S in the range of 300 to 100000 $\mu m^2$.

12. The developing member according to claim 10, wherein the domains have a horizontal Feret's diameter of 100 to 2000 μm.

13. The developing member according to claim 10, wherein the sum of the areas S of the domains present in a rectangular region of 3.0 mm in the longitudinal direction and 1.0 mm in the circumferential direction on the outer surface of the developing member is 15 to 50% of the area of the rectangular region.

14. An electrophotographic process cartridge configured to be detachably attachable to a body of an electrophotographic image forming apparatus, the electrophotographic process cartridge comprising a toner container containing a toner and a developing unit that carries the toner, the developing unit including a developing member, comprising:

a substrate having an outer surface containing a metal; and electrically insulating domains directly disposed on the outer surface of the substrate;

the electrophotographic developing member having an outer surface including the outer surface of the substrate, and surfaces of the electrically insulating domains, wherein when the surfaces of the domains constituting the outer surface of the developing member are electrically charged so as to have potential of $V_0$ (V), a potential decay time constant defined as a period of time necessary for a potential of each of the surfaces of the domains to decay to $V_0$×(1/e) (V) is 60.0 seconds or longer, and assuming that the electrically insulating domains are orthographically projected onto the electroconductive outer surface of the substrate to obtain projection images of the respective electrically insulating domains, at least one of the domains satisfies 0.05≤S/H≤0.80 where each of areas of the projection images is defined as S, and each of areas of convex envelopes of the projection images is defined as H.

* * * * *